US012552632B2

(12) United States Patent
Hirono et al.

(10) Patent No.: US 12,552,632 B2
(45) Date of Patent: Feb. 17, 2026

(54) SHEET PROCESSING DEVICE, IMAGE FORMING APPARATUS, AND IMAGE FORMING SYSTEM

(71) Applicants: Yusuke Hirono, Kanagawa (JP); Yuusuke Shibasaki, Tokyo (JP); Atsushi Shinoda, Kanagawa (JP); Shuuto Tohkaishi, Kanagawa (JP); Satoshi Hirata, Kanagawa (JP); Shingo Yoshizawa, Kanagawa (JP); Suzuka Fujita, Kanagawa (JP); Naofumi Yoshida, Kanagawa (JP); Ryota Takayama, Kanagawa (JP); Takahiro Watanabe, Kanagawa (JP); Takuya Morinaga, Tokyo (JP); Yuji Suzuki, Kanagawa (JP); Wataru Nozaki, Kanagawa (JP); Kanako Fujisaki, Kanagawa (JP); Jun Yamada, Kanagawa (JP)

(72) Inventors: Yusuke Hirono, Kanagawa (JP); Yuusuke Shibasaki, Tokyo (JP); Atsushi Shinoda, Kanagawa (JP); Shuuto Tohkaishi, Kanagawa (JP); Satoshi Hirata, Kanagawa (JP); Shingo Yoshizawa, Kanagawa (JP); Suzuka Fujita, Kanagawa (JP);

(Continued)

(73) Assignee: RICOH COMPANY, LTD., Tokyo (JP)

( * ) Notice: Subject to any disclaimer, the term of this patent is extended or adjusted under 35 U.S.C. 154(b) by 66 days.

(21) Appl. No.: 18/420,827

(22) Filed: Jan. 24, 2024

(65) Prior Publication Data

US 2024/0253923 A1 Aug. 1, 2024

(30) Foreign Application Priority Data

Jan. 30, 2023 (JP) ..... 2023-012198

(51) Int. Cl.
*B65H 45/14* (2006.01)
*B65H 29/52* (2006.01)
*B65H 43/08* (2006.01)

(52) U.S. Cl.
CPC ..... *B65H 45/14* (2013.01); *B65H 29/52* (2013.01); *B65H 43/08* (2013.01);
(Continued)

(58) Field of Classification Search
CPC ..... B65H 2301/17; B65H 2701/11232; B65H 2701/11234; B65H 45/14; B65H 45/16
See application file for complete search history.

(56) References Cited

U.S. PATENT DOCUMENTS 10,106,364 B2 * 10/2018 Watanabe ..... B65H 45/20
2007/0040328 A1 2/2007 Hattori
(Continued)

FOREIGN PATENT DOCUMENTS

JP 2009-113975 A 5/2009
JP 2014-105063 A 6/2014
(Continued)

OTHER PUBLICATIONS

Extended European Search Report issued Jun. 21, 2024 in European Patent Application No. 24152930.4, 7 pages.

*Primary Examiner* — Jeremy R Severson
(74) *Attorney, Agent, or Firm* — XSENSUS LLP

(57) ABSTRACT

A sheet processing device includes an upstream device, a downstream device, and a controller as circuitry. The upstream device includes multiple rollers to convey a sheet in a conveyance direction and perform a sheet processing. The downstream device is downstream from the upstream device in the conveyance direction. The downstream device includes a sheet sensor to detect the sheet. The controller controls a timing to rotate the multiple rollers of the (Continued)

upstream device to perform the sheet processing in response to a detection of the sheet by the sheet sensor.

10 Claims, 19 Drawing Sheets

(72) Inventors: Naofumi Yoshida, Kanagawa (JP); Ryota Takayama, Kanagawa (JP); Takahiro Watanabe, Kanagawa (JP); Takuya Morinaga, Tokyo (JP); Yuji Suzuki, Kanagawa (JP); Wataru Nozaki, Kanagawa (JP); Kanako Fujisaki, Kanagawa (JP); Jun Yamada, Kanagawa (JP)

(52) U.S. Cl.
CPC ..... *B65H 2301/17* (2013.01); *B65H 2402/10* (2013.01); *B65H 2404/63* (2013.01); *B65H 2553/41* (2013.01); *B65H 2701/11232* (2013.01); *B65H 2701/11234* (2013.01); *B65H 2801/27* (2013.01)

(56) References Cited

U.S. PATENT DOCUMENTS

| | | | |
|---|---|---|---|
| 2014/0147184 | A1 | 5/2014 | Kunieda et al. |
| 2015/0225201 | A1 | 8/2015 | Watanabe et al. |
| 2015/0360899 | A1 | 12/2015 | Takahashi et al. |
| 2016/0060072 | A1 | 3/2016 | Watanabe et al. |
| 2016/0068359 | A1 | 3/2016 | Suzuki et al. |
| 2016/0114999 | A1 | 4/2016 | Suzuki et al. |
| 2016/0221787 | A1 | 8/2016 | Matsushita et al. |
| 2016/0340144 | A1 | 11/2016 | Sakano et al. |
| 2016/0340145 | A1 | 11/2016 | Kunieda et al. |
| 2016/0360053 | A1 | 12/2016 | Suzuki et al. |
| 2017/0174465 | A1 | 6/2017 | Morinaga et al. |
| 2017/0217239 | A1 | 8/2017 | Suzuki et al. |
| 2018/0259895 | A1 | 9/2018 | Shibasaki et al. |
| 2019/0276263 | A1 | 9/2019 | Hidaka et al. |
| 2019/0284006 | A1 | 9/2019 | Hoshino et al. |
| 2019/0284008 | A1 | 9/2019 | Sakano et al. |
| 2019/0284009 | A1 | 9/2019 | Suzuki et al. |
| 2019/0284010 | A1 | 9/2019 | Asami et al. |
| 2019/0284011 | A1 | 9/2019 | Furuhashi et al. |
| 2019/0284012 | A1 | 9/2019 | Yoneyama et al. |
| 2019/0367317 | A1 | 12/2019 | Haraguchi et al. |
| 2020/0103811 | A1 | 4/2020 | Sugiyama et al. |
| 2020/0239265 | A1 | 7/2020 | Suzuki et al. |
| 2020/0307936 | A1 | 10/2020 | Sugawara et al. |
| 2020/0307944 | A1 | 10/2020 | Shibasaki et al. |
| 2020/0385231 | A1 | 12/2020 | Kunieda et al. |
| 2020/0407187 | A1 | 12/2020 | Hidaka et al. |
| 2021/0039900 | A1 | 2/2021 | Shimazu et al. |
| 2021/0316955 | A1 | 10/2021 | Shibasaki et al. |
| 2021/0347589 | A1 | 11/2021 | Suzuki et al. |
| 2021/0403273 | A1 | 12/2021 | Haraguchi et al. |
| 2022/0055855 | A1 | 2/2022 | Shinoda et al. |
| 2022/0289512 | A1 | 9/2022 | Takahashi et al. |
| 2022/0334523 | A1 | 10/2022 | Akiyama et al. |
| 2022/0363088 | A1 | 11/2022 | Yoshizawa et al. |
| 2022/0380166 | A1 | 12/2022 | Nozaki et al. |
| 2023/0001731 | A1 | 1/2023 | Haraguchi et al. |
| 2023/0331029 | A1 | 10/2023 | Suzuki et al. |
| 2023/0331507 | A1 | 10/2023 | Ota et al. |
| 2023/0391568 | A1 | 12/2023 | Nozaki |

FOREIGN PATENT DOCUMENTS

| | | |
|---|---|---|
| JP | 2014-162637 A | 9/2014 |
| JP | 2020-104976 A | 7/2020 |
| JP | 2020-189717 A | 11/2020 |

* cited by examiner

SHEET PROCESSING DEVICE, IMAGE FORMING APPARATUS, AND IMAGE FORMING SYSTEM

CROSS-REFERENCE TO RELATED APPLICATION

This patent application is based on and claims priority pursuant to 35 U.S.C. § 119(a) to Japanese Patent Application No. 2023-012198, filed on Jan. 30, 2023, in the Japan Patent Office, the entire disclosure of which is hereby incorporated by reference herein.

BACKGROUND

Technical Field

Embodiments of the present disclosure relate to a sheet processing device, an image forming apparatus, and an image forming system.

Related Art

Sheet processing devices are known in the related art that perform a folding process to fold a sheet into a predetermined shape (for example, Z-fold, letter fold-out, or half-fold). Image forming apparatuses are also known in the related art that have a function similar to the sheet processing apparatus and perform the folding process to fold a sheet on which an image is formed. Image forming systems are also known in the related art that include the image forming apparatus and the sheet processing device that work together.

SUMMARY

This specification describes an improved sheet processing device that includes an upstream device, a downstream device, and circuitry. The upstream device includes multiple rollers to convey a sheet in a conveyance direction and perform a sheet processing. The downstream device is downstream from the upstream device in the conveyance direction. The downstream device includes a sheet sensor to detect the sheet. The circuitry controls a timing to rotate the multiple rollers of the upstream device to perform the sheet processing in response to a detection of the sheet by the sheet sensor.

This specification also describes an improved image forming apparatus that includes an image forming section, an upstream device, a downstream device, and circuitry. The image forming section forms an image on a sheet. The upstream device includes multiple rollers to convey the sheet, on which the image is formed by the image forming section, in a conveyance direction and perform a sheet processing. The downstream device is downstream from the upstream device in the conveyance direction. The downstream device includes a sheet sensor to detect the sheet. The circuitry controls a timing to rotate the multiple rollers to perform the sheet processing based on a detection of the sheet by the sheet sensor.

This specification further describes an image forming system including the sheet processing device.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

DETAILED DESCRIPTION

Figure 1:
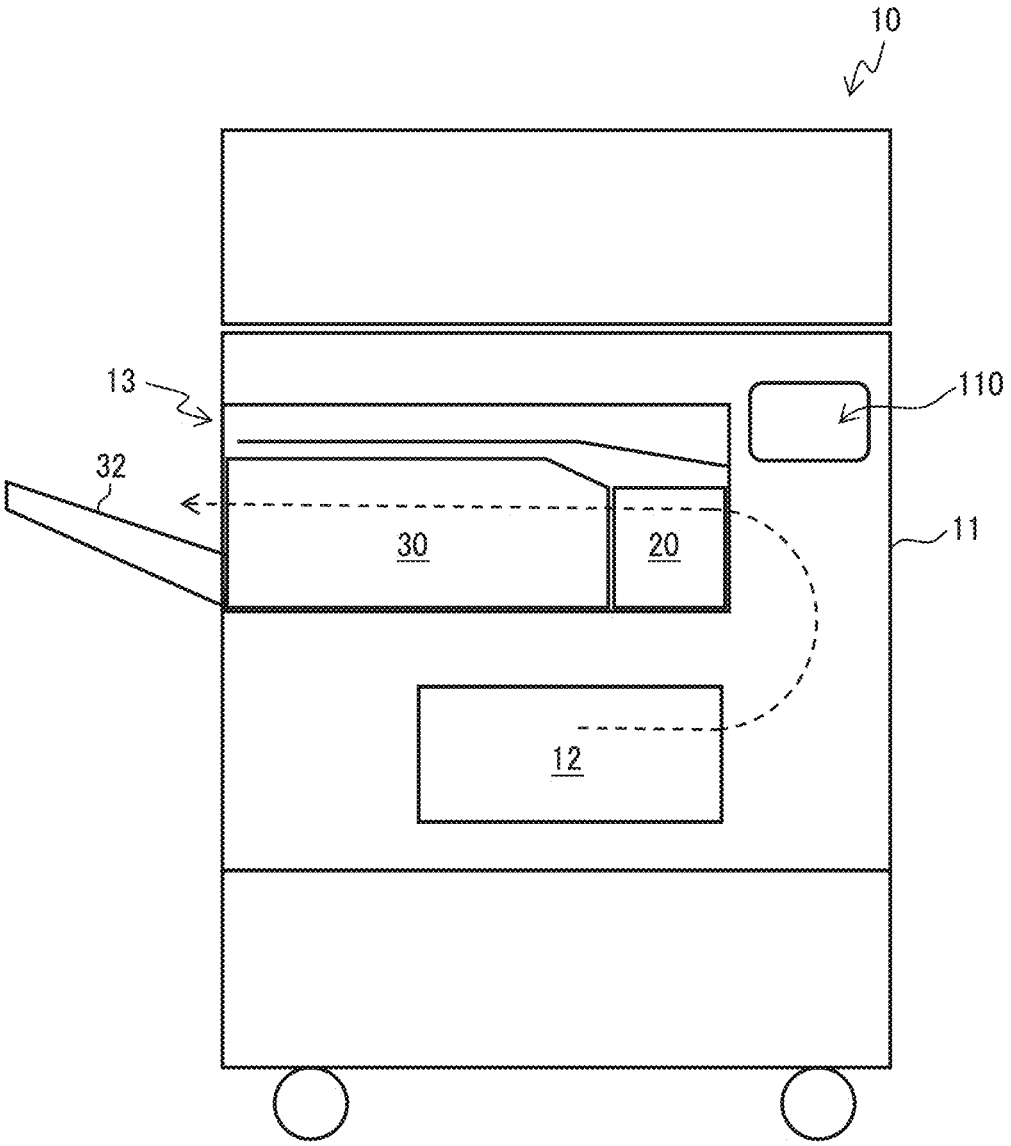
FIG. 1 is a schematic diagram of an image forming apparatus according to an embodiment of the present disclosure.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

With reference to drawings, descriptions are given below of embodiments of the present disclosure. In the drawings illustrating embodiments of the present disclosure, elements or components having identical or similar functions or shapes are given similar reference numerals as far as distinguishable, and redundant descriptions are omitted.

A description is provided of an image forming apparatus 10 according to embodiments of the present disclosure with reference to the drawings. FIG. 1 is a schematic diagram of the image forming apparatus 10 according to the present embodiment. The image forming apparatus 10 forms an image on a sheet-shaped recording medium. In the present embodiment, a "sheet S" is used as an example of the sheet-shaped recording medium. The sheet S is typically a sheet of plain paper but is not limited to this as long as the sheet S can be subjected to processing according to the present embodiment.

As illustrated in FIG. 1, the image forming apparatus 10 includes a housing 11 and an image forming section 12.

The image forming apparatus is a so-called in-body type, and the sheet S subjected to image forming processes in the image forming section 12 is ejected toward an in-body space 13.

The housing 11 has a box shape to form an internal space for accommodating components of the image forming apparatus 10. The housing 11 has the in-body space 13 that is accessible from the outside of the image forming apparatus 10. The in-body space 13 is located, for example, slightly above the center of the housing 11 in the vertical direction. The in-body space opens a space extending toward a direction in which the sheet is ejected after the image forming section 12 forms the image on the sheet. The in-body space 13 is exposed to the outside as a portion of the outer wall of the housing 11 is cut out. The in-body space 13 accommodates a sheet folder 20 as a sheet folding device that can perform predetermined sheet processing and a sheet binder 30 as a post-processing device. A sheet processing device according to the embodiments of the present disclosure includes the sheet folder 20 as an upstream device and the sheet binder 30 as a downstream device.

The image forming section 12 forms the image on a sheet S stored in the tray and ejects the sheet S on which the image is formed to the sheet folder 20 or the sheet binder 30. The image forming section 12 may include an inkjet image forming device that forms an image with ink or an electrophotographic image forming device that forms an image with toner. Since the image forming section 12 of FIG. 1 has a known configuration, a detailed description of the configuration and functions of the image forming section 12 is omitted.

The sheet folder 20 serving as the sheet processing device is in the in-body space 13 that is a cavity of the image forming apparatus 10 and is located downstream from the image forming section 12 and upstream from the sheet binder 30 in a conveyance passage of the sheet S from the image forming section 12 to the outside of the image forming apparatus 10 via the sheet binder 30. The conveyance passage is indicated by a dashed line and an arrow in FIG. 1. The sheet S on which the image is formed by the image forming section 12 is first delivered to the sheet folder 20 and subjected to a folding process described later and subsequently delivered to the sheet binder 30 and subjected to a jogging process and a binding process.

The sheet folder 20 is configured to be attachable to and detachable from the image forming apparatus 10. After the sheet folder 20 is removed, the sheet S on which the image is formed by the image forming section 12 is directly delivered to the sheet binder 30 and subjected to the binding process. After the sheet folder 20 is removed, a puncher that performs a punching process to punch a hole in the sheet S may be installed at the position at which the sheet folder 20 is disposed. After the puncher is attached, the sheet S on which the image is formed by the image forming section 12 is firstly delivered to the puncher and subjected to the punching process and then delivered to the sheet binder 30 and subjected to the binding process. A unit attached to the position in the in-body space 13 from which the sheet folder 20 is removed is not limited to the puncher, and a unit performing any processing on the sheet S may be attached to the position.

[Internal Configuration of Sheet Folder 20 and Sheet Binder 30]

Figure 2:
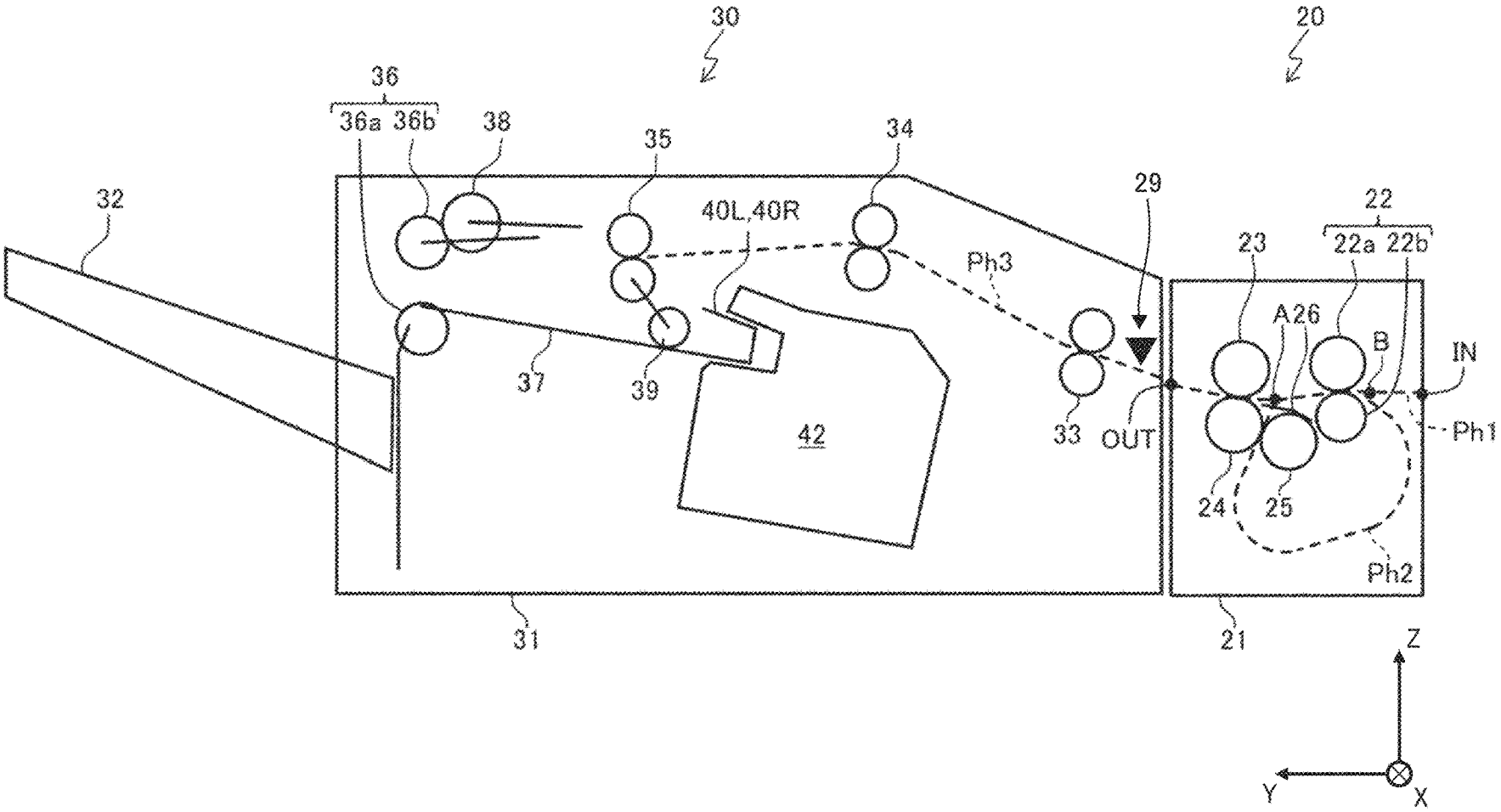
FIG. 2 is a diagram illustrating a configuration of a sheet folder and a sheet binder, according to an embodiment of the present disclosure.

FIG. 2 is a schematic diagram illustrating an internal configuration of each of the sheet folder 20 and the sheet binder 30, according to the present embodiment. Each of the sheet folder 20 and the sheet binder 30 is manufactured as a unit and has an input interface and an output interface that can be connected to each other to convey the sheet S. The input interface IN of the sheet folder 20 is configured to be connectable to an output interface of the image forming section 12. The input interface of the sheet binder 30 is configured to be connectable to the output interface of the image forming section 12 and the output interface OUT of the sheet folder 20.

Installing the sheet folder 20 and the sheet binder 30 to the image forming apparatus 10 and connecting the input interface IN and the output interface OUT enable communication of mutual operation data and control data. The communication of the mutual operation data and the control data enables the execution of various processes as will be described later.

Figure 3A:
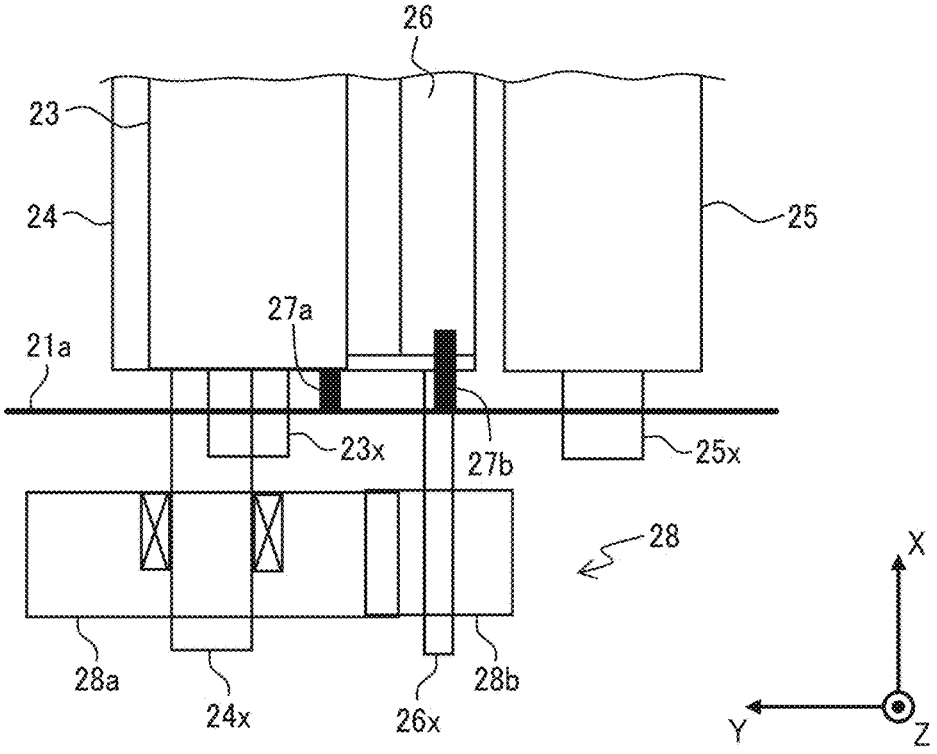
FIG. 3A is a diagram illustrating a part of the sheet folder of FIG. 2 viewed in a direction orthogonal to a sheet on the main conveyance path.
Figure 3B:
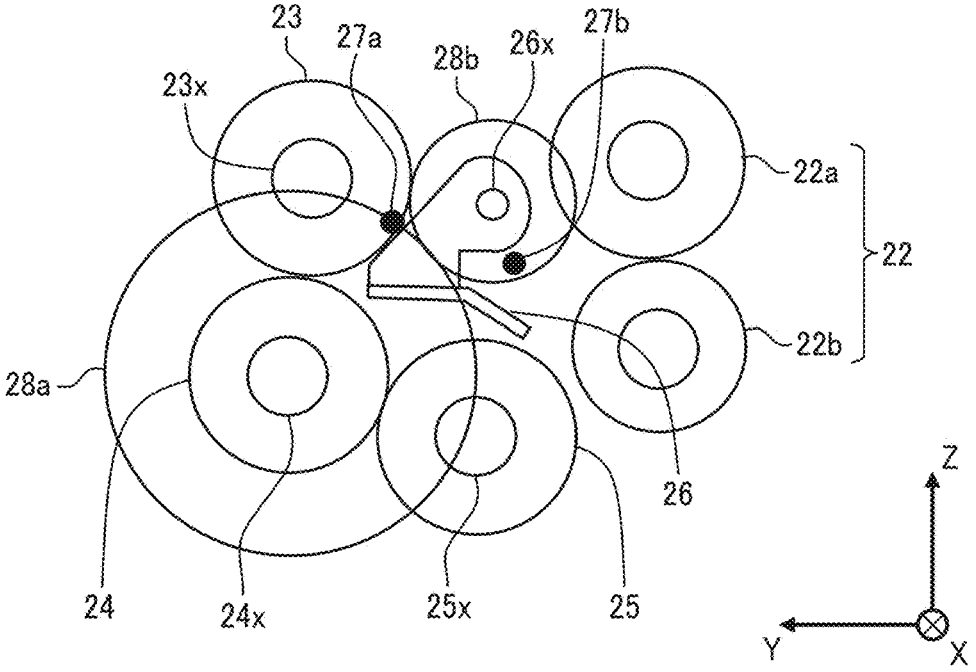
FIG. 3B is a diagram illustrating the sheet folder of FIG. 3A viewed in the width direction of a sheet.

The sheet folder 20 performs the folding process in which the sheet S on which the image is formed by the image forming section 12 is folded into a predetermined shape (for example, Z-fold, letter fold-out, or half-fold). As illustrated in FIG. 2, the sheet folder 20 includes a folder housing 21, a conveyance roller pair 22 as a conveyor, a first folding roller 23, a second folding roller 24, a third folding roller 25, and a guide plate 26 as a guide. In addition, as illustrated in FIGS. 3A and 3B, the sheet folder 20 includes a first stopper 27*a*, a second stopper 27*b*, and a driving-force transmission 28.

The folder housing 21 has a box shape to form an internal space for accommodating components of the sheet folder 20. In addition, a main conveyance path Ph1 and a return conveyance path Ph2, which are spaces through which the sheet S passes, are formed in the internal space of the folder housing 21. The main conveyance path Ph1 is a conveyance path from an input interface IN coupled to the image forming section 12 to an output interface OUT coupled to the sheet binder 30. In the following description, a direction from the input interface IN to the exit interface OUT on the main conveyance path Ph1 is referred to as a conveyance direction. The return conveyance path Ph2 is an annular conveyance path that branches from the main conveyance path Ph1 at a branch position A and joins the main conveyance path Ph1 at a joining position B. The sheet S is conveyed from an upstream portion of the main conveyance path Ph1 to a downstream portion of the main conveyance path Ph1 and conveyed from the branch position A along the return conveyance path Ph2. The sheet S in the return conveyance path Ph2 is conveyed to return to the upstream portion of the main conveyance path Ph1 from the joining position B. The joining position B is located upstream from the branch position A in the conveyance direction.

The conveyance roller pair 22 conveys the sheet S along the main conveyance path Ph1 in the conveyance direction. The conveyance roller pair 22 is located upstream from the branch position A and downstream from the joining position B (in other words, between the branch position A and the joining position B). The conveyance roller pair 22 is configured by a driving roller 22*a* and a driven roller 22*b* that face each other via the main conveyance path Ph1. The driving roller 22*a* and the driven roller 22*b* are rotatably supported by the folder housing 21. A conveyance motor 22*c* (see FIG. 4) transmits a driving force to the driving roller 22*a*, and the driving force rotates the driving roller 22*a* clockwise in FIG. 2 to convey the sheet S in the conveyance direction. This rotation is referred to as "forward rotation".

The driven roller 22*b* is disposed to face the driving roller 22*a* via the main conveyance path Ph1 and is driven and rotated by the rotation of the driving roller 22*a*. Driving the conveyance motor 22*c* conveys the sheet S nipped by the driving roller 22*a* and the driven roller 22*b* along the main conveyance path Ph1 in the conveyance direction.

The first folding roller 23 is rotatably supported by the folder housing 21 at a position facing the main conveyance path Ph1. The second folding roller 24 is rotatably supported by the folder housing 21 at a position facing both the main conveyance path Ph1 and the return conveyance path Ph2. The third folding roller 25 is rotatably supported by the folder housing 21 at a position facing the return conveyance path Ph2. The first folding roller 23 and the second folding roller 24 are disposed to face each other via the main conveyance path Ph1 and are downstream from the branch position A in the conveyance direction. The second folding roller 24 and the third folding roller 25 are disposed between the branch position A and the joining position B to face each other via the return conveyance path Ph2.

A first folding motor 23*a* (see FIG. 4) transmits a driving force to the first folding roller 23 to rotate the first folding roller 23 in forward and reverse directions. Rotating the first folding roller 23 in the forward direction conveys the sheet S on the main conveyance path Ph1 in the conveyance direction. The reverse rotation of the first folding roller 23 is rotation in a direction opposite to the forward rotation. The first folding motor 23*a* is configured to be rotatable in forward and reverse directions to rotate the first folding roller 23 in forward and reverse directions.

A second folding motor 24*a* (see FIG. 4) transmits a rotational driving force to the second folding roller 24 to rotate the second folding roller 24 in forward and reverse directions. Rotating the second folding roller 24 in the forward direction conveys the sheet S on the main conveyance path Ph1 in the conveyance direction and conveys the sheet S on the return conveyance path Ph2 from the joining position B to the branch position A. The reverse rotation of the second folding roller 24 is rotation in a direction opposite to the forward rotation. The second folding motor 24*a* is configured to be rotatable in forward and reverse directions to rotate the second folding roller 24 in forward and reverse directions.

A third folding motor 25*a* (see FIG. 4) transmits a driving force to the third folding roller 25 to rotate the third folding roller 25 in forward and reverse directions. Rotating the third folding roller 25 in the forward direction conveys the sheet S on the return conveyance path Ph2 from the joining position B to the branch position A. The reverse rotation of the third folding roller 25 is rotation in a direction opposite to the forward rotation. The third folding motor 25*a* is configured to be rotatable in forward and reverse directions to rotate the third folding roller 25 in forward and reverse directions.

The guide plate 26 is rotatably supported by the folder housing 21 in the vicinity of the branch position A. The guide plate 26 is configured to be rotatable between a first posture illustrated in FIG. 7B and FIG. 10B and a second posture illustrated in FIG. 8B and FIG. 9B. The guide plate 26 in the first posture allows conveying the sheet S on the main conveyance path Ph1 in the conveyance direction and prevents the sheet S conveyed on the main conveyance path Ph1 in the conveyance direction from entering the return conveyance path Ph2 through the branch position A. On the other hand, the guide plate 26 in the first posture allows the sheet S on the return conveyance path Ph2 to enter the main conveyance path Ph1 through the branch position A. The guide plate 26 in the second posture allows conveying the sheet S from one of the main conveyance path Ph1 and the return conveyance path Ph2 to the other through the branch position A.

[Configuration of Sheet Folder 20]

FIGS. 3A and 3B illustrate an example of a folding mechanism in the sheet folder 20. FIG. 3A illustrates a part of the sheet folder 20 viewed in a direction orthogonal to the sheet S on the main conveyance path Ph1, and FIG. 3B illustrates the sheet folder viewed in the width direction of the sheet S. As illustrated in FIG. 3A, the rotation shaft 23*x* of the first folding roller 23, the rotation shaft 24*x* of the second folding roller 24, the rotation shaft 25*x* of the third folding roller 25, and the rotation shaft 26*x* of the guide plate 26 extend in the width direction of the sheet S. The rotation shafts 23*x*, 24*x*, 25*x*, and 26*x* penetrate a partition 21*a* inside the folder housing 21. The driving-force transmission 28 is disposed outside the partition 21*a*, and the first folding roller 23, the second folding roller 24, the third folding roller 25, the guide plate 26 are inside the partition 21*a*.

The driving-force transmission 28 transmits the driving force of the second folding motor 24*a* to the second folding roller 24 and the guide plate 26 to drive the second folding roller 24 and the guide plate 26 in conjunction with each other. Specifically, the driving-force transmission 28 rotates the guide plate 26 from the second posture toward the first posture in conjunction with the forward rotation of the second folding roller 24. The driving-force transmission 28 rotates the guide plate 26 from the first posture toward the second posture in conjunction with the reverse rotation of the second folding roller 24. As illustrated in FIGS. 3A and 3B, the driving-force transmission 28 includes, for example, a torque limiter 28*a* and a driven gear 28*b*.

An output shaft of the second folding motor 24*a* is coupled to the rotation shaft 24*x* of the second folding roller 24. The torque limiter 28*a* is attached to the rotation shaft 24*x* of the second folding roller 24 and rotate integrally with the second folding roller 24. The driven gear 28*b* is attached to the rotation shaft 26*x* of the guide plate 26 and rotates integrally with the guide plate 26. The torque limiter 28*a* and the driven gear 28*b* are engaged with each other.

As a result, the driving-force transmission 28 transmits the driving force of the second folding motor 24*a* to the second folding roller 24. In addition, the driving force of the second folding motor 24*a* is transmitted to the guide plate 26 through the torque limiter 28*a* and the driven gear 28*b*. Specifically, rotating the second folding motor 24*a* in the forward direction rotates the second folding roller 24 in the forward direction and rotates the guide plate 26 from the second posture toward the first posture. On the other hand, rotating the second folding motor 24*a* in the reverse direction rotates the second folding roller 24 in the reverse direction and rotates the guide plate 26 from the first posture toward the second posture.

The torque limiter 28*a* transmits the driving force of the second folding motor 24*a* to the driven gear 28*b* while the rotational torque is less than a threshold value. In other words, the torque limiter 28*a* transmits the driving force of the second folding motor 24*a* to the guide plate 26 while the guide plate 26 is separated from the first stopper 27*a* and the second stopper 27*b*). In contrast, the torque limiter 28*a* releases (i.e., idles) the transmission of the driving force from the second folding motor 24*a* to the driven gear 28*b* (in other words, the guide plate 26) while the rotational torque is equal to or larger than the threshold value (in other words, while the guide plate 26 is in contact with the first stopper 27*a* or the second stopper 27*b*).

The number of teeth Z1 of the torque limiter 28*a* is larger than the number of teeth Z2 of the driven gear 28*b* (Z1>Z2). As a result, the driving-force transmission 28 increases the rotation speed of the guide plate 26 to be larger than the rotation speed of the second folding motor 24*a*. Specifically, one rotation of the second folding motor 24*a* rotates the second folding roller 24 once as a first number of rotations and rotates the guide plate 26 by a second number of rotations that is Z1/Z2 rotations larger than the first number of rotations. The above-described configuration can quickly change the posture of the guide plate 26.

As illustrated in FIG. 2, the sheet binder 30 as a downstream device includes a sheet sensor 29 disposed on a conveyance path Ph3 that is a sheet conveyance path. The sheet sensor 29 is, for example, an optical sensor including a light-emitting element and a light-receiving element. The light-emitting element emits light to the sheet, and the light-receiving element receives the light reflected by the sheet to detect the sheet. The sheet sensor 29 is not limited to the optical sensor. The sheet sensor may be a mechanical sensor. The sheet sensor 29 is used to detect whether the sheet S reaches each of predetermined positions on the main conveyance path Ph1 and the return conveyance path Ph2 in the sheet folder 20. In other words, the folding process in the sheet folder 20 is executed based on results of detection by the sheet sensor 29 outside the folder housing 21. The sheet sensor 29 is disposed at a position at which the sheet sensor 29 can detect the position of the sheet S in the main conveyance path Ph1. The sheet folder 20 includes rotary encoders 22*z*, 23*z*, 24*z*, and 25*z* (see FIG. 4) to detect the numbers of rotations of the rollers 22*a*, 23, 24, and 25.

A controller 100, which is described below, can determine the positions of the sheet S in the main conveyance path Ph1 and the return conveyance path Ph2 based on results of detection by the sheet sensor 29 and the numbers of rotations of the rollers 22*a*, 23, 24, and 25 detected by the rotary encoders 22*z*, 23*z*, 24*z*, and 25*z* to control the folding process.

Specifically, the controller 100 that serves as circuitry determines the position of the sheet S based on the numbers of pulse signals output from the rotary encoders 22*z*, 23*z*, 24*z*, and 25*z* after the sheet sensor 29 detects the sheet S. As a result, the controller 100 can determine the timings to perform processes of steps S602, S604, S606, S1202, S1204, and S1206, which are described later in detail.

The position of the sheet sensor 29 is the most upstream position on the conveyance path Ph3 of the sheet binder 30 and upstream from a conveyance roller pair 33 in the conveyance direction. In other words, the sheet sensor 29 is adjacent to an entrance of the sheet binder 30 that is the input interface of the sheet binder 30. The sheet sensor 29 is close to a connecting position at which the sheet binder 30 is connected to the sheet folder 20. The sheet sensor 29 is disposed at a position at which the sheet sensor 29 can detect an edge of the sheet S conveyed from the sheet folder 20 performing the folding process described later. The position at which the sheet sensor 29 is disposed corresponds to the detection position of the sheet S. The position of the sheet sensor 29 is not limited to one position. Multiple sheet sensors may be at multiple positions.

[Sheet Binder 30]

Returning to FIG. 2, a description is given below. The sheet binder 30 performs the binding process as post-processing that binds multiple sheets S on which images are formed by the image forming section 12. In the following description, multiple sheets S is referred to as a sheet bundle Sb. In the present embodiment, the sheet binder 30 is described as an example of the post-processing device, but the post-processing device is not limited to this. The sheet binder 30 includes a housing 31, an output tray 32, multiple conveyance roller pairs 33, 34, 35, and 36, an internal tray 37, a tapping roller 38, a return roller 39, end fences 40L and 40R, side fences 41L and 41R, and a binder 42.

The housing 31 has a box shape to form an internal space for accommodating components of the sheet binder 30. In addition, the conveyance path Ph3 as a space through which the sheet S passes is formed in the internal space of the housing 31. The output tray 32 is supported on an outer side face of the housing 31. The output tray 32 supports the sheet S or the sheet bundle Sb conveyed by the conveyance roller pairs 33 to 36.

The conveyance roller pairs 33 to 36 are arranged on the conveying path Ph3 at predetermined intervals. The conveyance roller pairs 33 to 36 convey the sheet S along the conveyance path Ph3. The basic configuration of the conveyance roller pairs 33 to 36 is common to that of the conveyance roller pair 22 of the sheet folder 20. The conveyance roller pair 36 is configured by a driving roller 36*a* and a driven roller 36*b* that can be brought into contact with and separated from the driving roller 36*a*. The conveyance roller pair 35 may be configured to be slidable in the width direction in order to implement a sorting process in which the sheets S are shifted in the width direction and ejected to the output tray 32.

Multiple sheets S are sequentially conveyed on the conveyance path Ph3 and temporarily supported and stacked on the internal tray 37. The tapping roller 38 is supported at an end of a rotation arm above the internal tray 37. As the rotation arm is rotated, the tapping roller 38 supplies the sheet S nipped by the conveyance roller pair 36 to the internal tray 37. The return roller 39 contacts the upper face of the sheet S supported by the internal tray 37 and rotates to guide the sheet S toward the end fences 40L and 40R.

The end fences 40L and 40R contact downstream ends of the sheets S supported by the internal tray 37 in the conveyance direction and align the positions of the sheets S in the conveyance direction. The side fences 41L and 41R contact both ends of the sheets S supported by the internal tray 37 in the width direction and align the positions of the sheets S in the width direction. The binder 42 performs the binding process in which the sheet bundle Sb supported by the internal tray 37 is bound. The binding process performed by the binder 42 may be a staple binding process in which inserting a binding staple into the sheet bundle Sb binds the sheet bundle Sb or a pressure binding process in which deforming the sheet bundle Sb under pressure binds the sheet bundle Sb. The sheet binder 30 may include a staple binder that performs the staple binding process and a crimp binder that performs the pressure binding process, which are operable independently of each other at positions spaced apart from each other in the width direction.

In addition, the housing 31 may have a manual staple slit disposed at a position facing the binder 42. An operator may insert the sheet bundle into the binder 42 through the manual staple slit and press a manual staple button of an operation panel 110 described below, and the binder 42 performs the binding process.

[Control Block of Sheet Folder 20]

Figure 4:
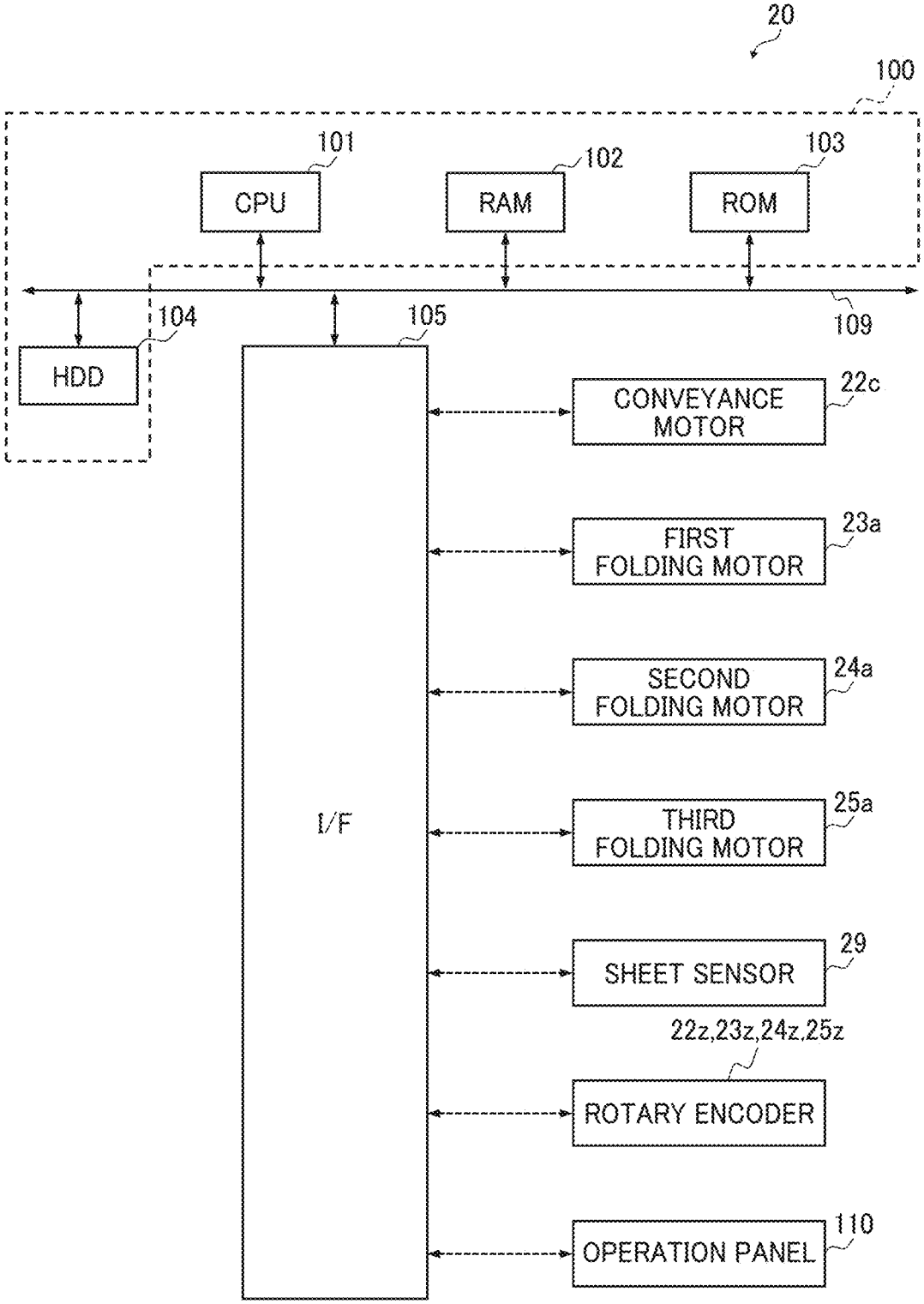
FIG. 4 is a block diagram illustrating a hardware configuration of a sheet folder according to an embodiment of the present disclosure.

Subsequently, a control configuration to control the folding process of the sheet folder 20 is described. FIG. 4 is a block diagram illustrating the hardware configuration to control the sheet folder 20, according to the present embodiment. As illustrated in FIG. 4, the sheet folder 20 includes the controller 100 as a control device. The controller 100 includes a central processing unit (CPU) 101, a random-access memory (RAM) 102, a read-only memory (ROM) 103, a hard disk drive (HDD) 104, and an interface (I/F) 105. The CPU 101, the RAM 102, the ROM 103, the HDD 104, and the I/F 105 are connected to each other via a common bus 109.

The CPU 101 is an arithmetic unit and controls the general operations of the sheet folder 20. The RAM 102 is a volatile storage medium that allows data to be read and written at high speed. The CPU 101 uses the RAM 102 as a working area for data processing. The ROM 103 is a read-only non-volatile storage medium that stores programs such as firmware. The HDD 104 is a non-volatile storage medium that allows data to be read and written and has a relatively large storage capacity. The HDD 104 stores, for example, an operating system (OS), various control programs, and application programs.

In the sheet folder 20, the CPU 101 executes a control program stored in the ROM 103 and a data-processing program (application program) loaded into the RAM 102 from a recording medium such as the HDD 104 using an arithmetic function. Such processing configures a software controller including various functional modules of the sheet folder 20. The software controller thus configured cooperates with hardware resources of the sheet folder 20 to construct functional blocks that implement functions of the sheet folder 20. In other words, the CPU 101, the RAM 102, the ROM 103, and the HDD 104 construct the controller 100 as the circuitry that controls the operation of the sheet folder 20.

The I/F 105 is an interface that connects the conveyance motor 22*c*, the first folding motor 23*a*, the second folding motor 24*a*, the third folding motor 25*a*, the sheet sensor 29, the rotary encoders 22*z*, 23*z*, 24*z*, and 25*z*, and the operation panel 110 to the common bus 109. The controller 100 acquires data from the sheet sensor 29 via an output terminal of the sheet binder 30 and I/F 105. In addition, the controller 100 acquires data from the rotary encoders 22*z*, 23*z*, 24*z*, and 25*z*, and the operation panel 110 through the I/F 105 and operates the conveyance motor 22*c*, the first folding motor 23*a*, the second folding motor 24*a*, and the third folding motor 25*a*.

Although FIG. 4 illustrates only the components used for the folding process in the sheet folder 20, the controller 100 may also control the operations of the image forming section 12 and the sheet binder 30. Alternatively, the controller 100 as the circuitry may operate the sheet folder 20 in conjunction with the image forming section 12 and the sheet binder 30 by communicating with a controller that controls the operations of the image forming section 12 and a controller that controls the operations of the sheet binder 30.

The operation panel 110 includes an operation device that receives instructions from the operator and a display serving as an indicator that notifies the operator of information. The operation device includes, for example, physical input buttons and a touch panel overlaid on a display. The operation panel 110 acquires information from the operator through the operation device and provides the operator with information through the display. Examples of the indicator are not limited to the display and may be, for example, a light-emitting diode (LED) lamp or a speaker.

Figure 5A:
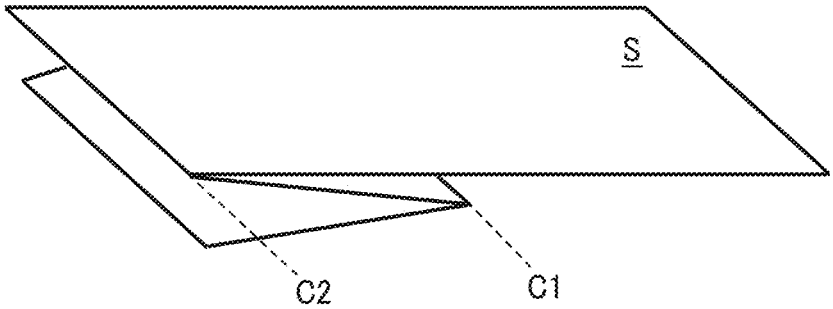
FIGS. 5A to 5C are perspective views of sheets to illustrate various folding methods that can be achieved by a sheet folder according to an embodiment of the present disclosure.
Figure 5B:
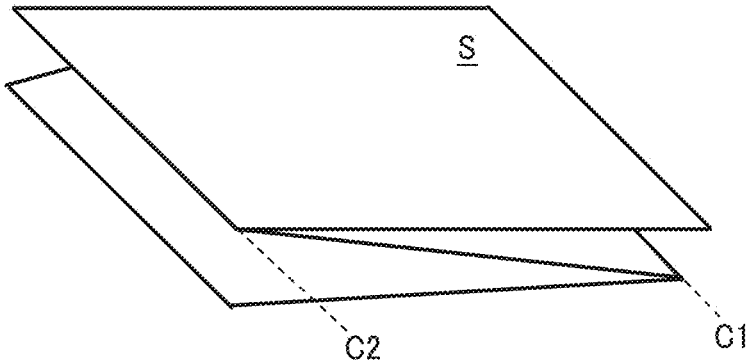
Figure 5C:
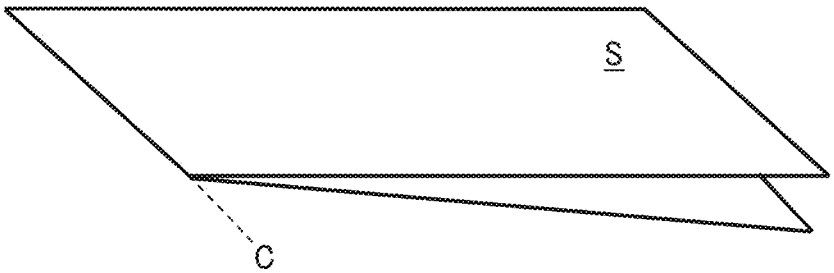

FIGS. 5A to 5C are perspective views of sheets S to illustrate various folding methods that can be achieved by the sheet folder 20 according to the present embodiment. FIG. 5A is a perspective view of the sheet S folded by a so-called Z-fold. In the Z-fold, the sheet S having the total length L in the conveyance direction is folded at a first fold position C1 at L/4 from the leading edge of the sheet S and subsequently folded at a second fold position C2 at L/2 from the leading edge of the sheet S in an opposite direction. The second fold position C2 is upstream from the first fold position C1 in the conveyance direction. FIG. 5B is a perspective view of the sheet S folded by a so-called letter fold-out. In the letter fold-out, the sheet S having the total length L in the conveyance direction is folded at a first fold position C1 at L/3 from the leading edge of the sheet S and subsequently folded at a second fold position C2 at 2L/3 from the leading edge of the sheet S in an opposite direction. The second fold position C2 is upstream from the first fold position C1 in the conveyance direction. FIG. 5C is a perspective view of the sheet S folded by a so-called half-fold. In the half-fold, the sheet S having the total length L in the conveyance direction is folded at a fold position C at L/2 from the leading edge of the sheet S.

[Three-Folding Process Flow]

Figure 6:
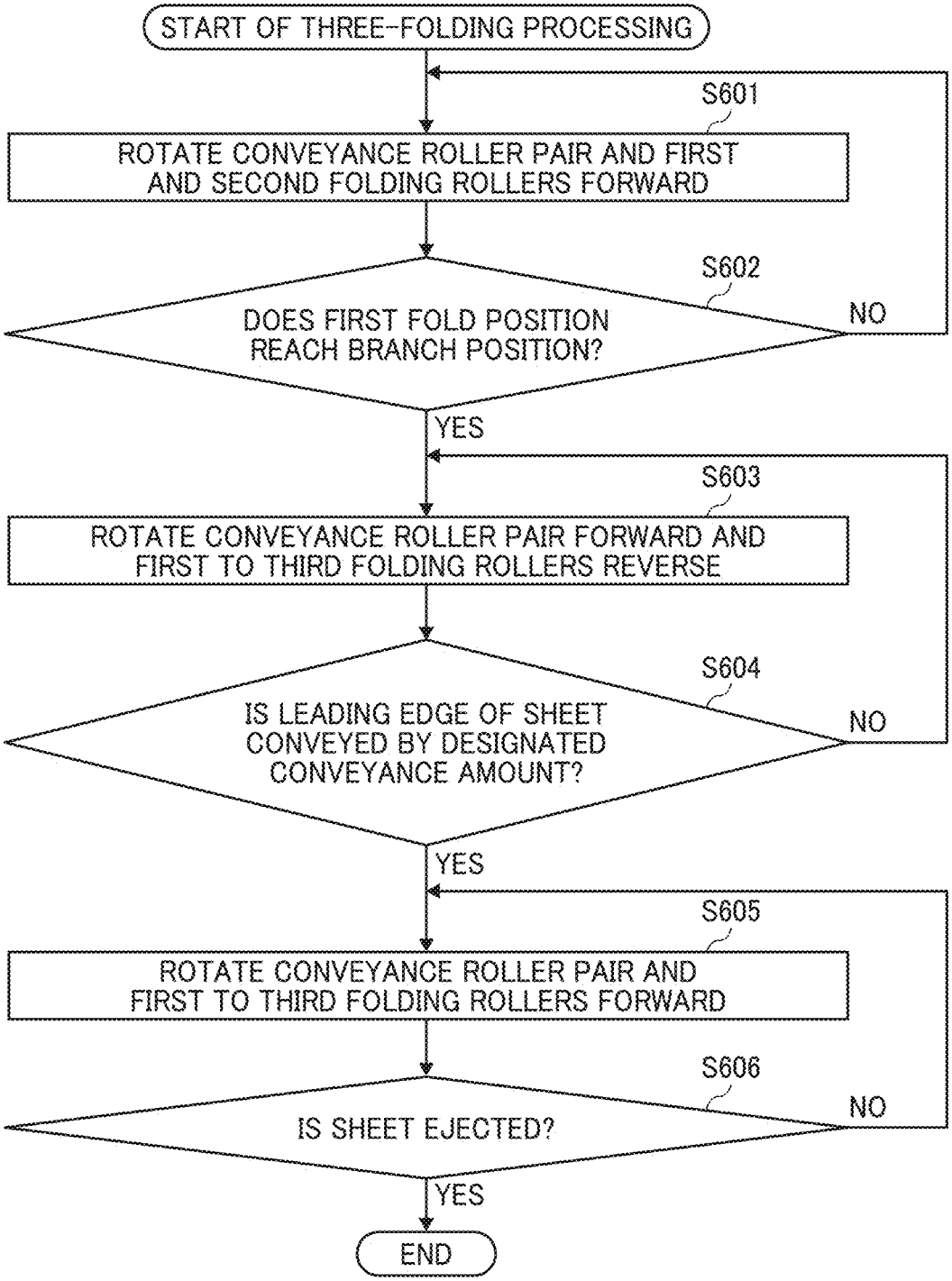
FIG. 6 is a flowchart of a three-folding process according to an embodiment of the present disclosure.
Figure 8A:
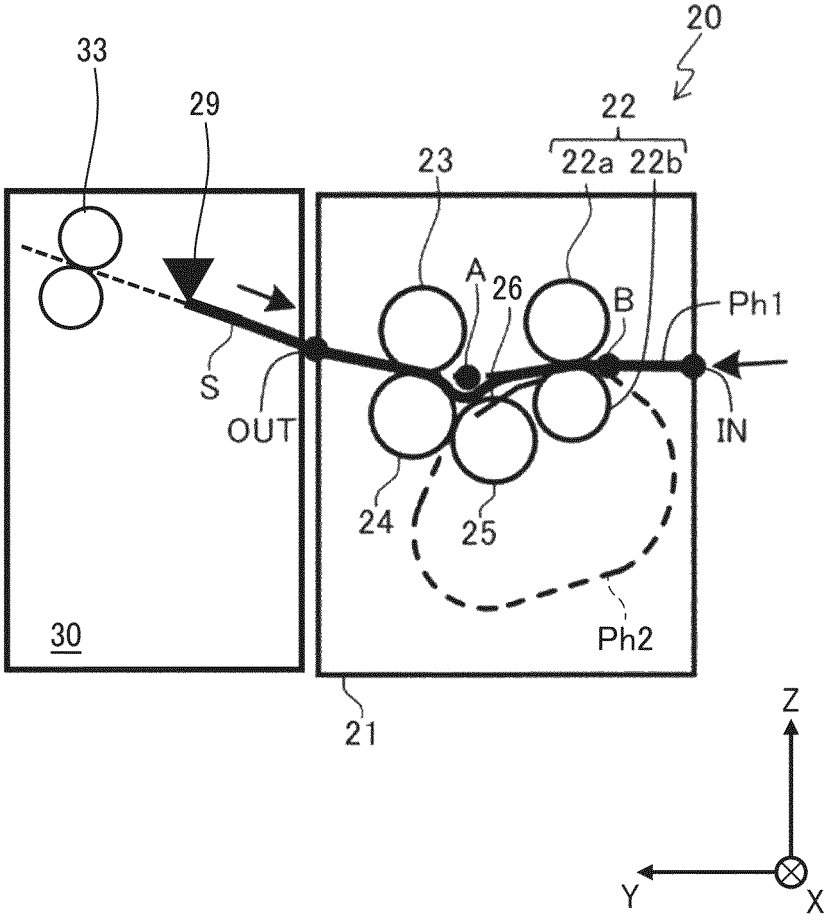
FIGS. 8A and 8B are diagrams illustrating a sheet folder folding a sheet at a first fold position, according to an embodiment of the present disclosure.
Figure 8B:
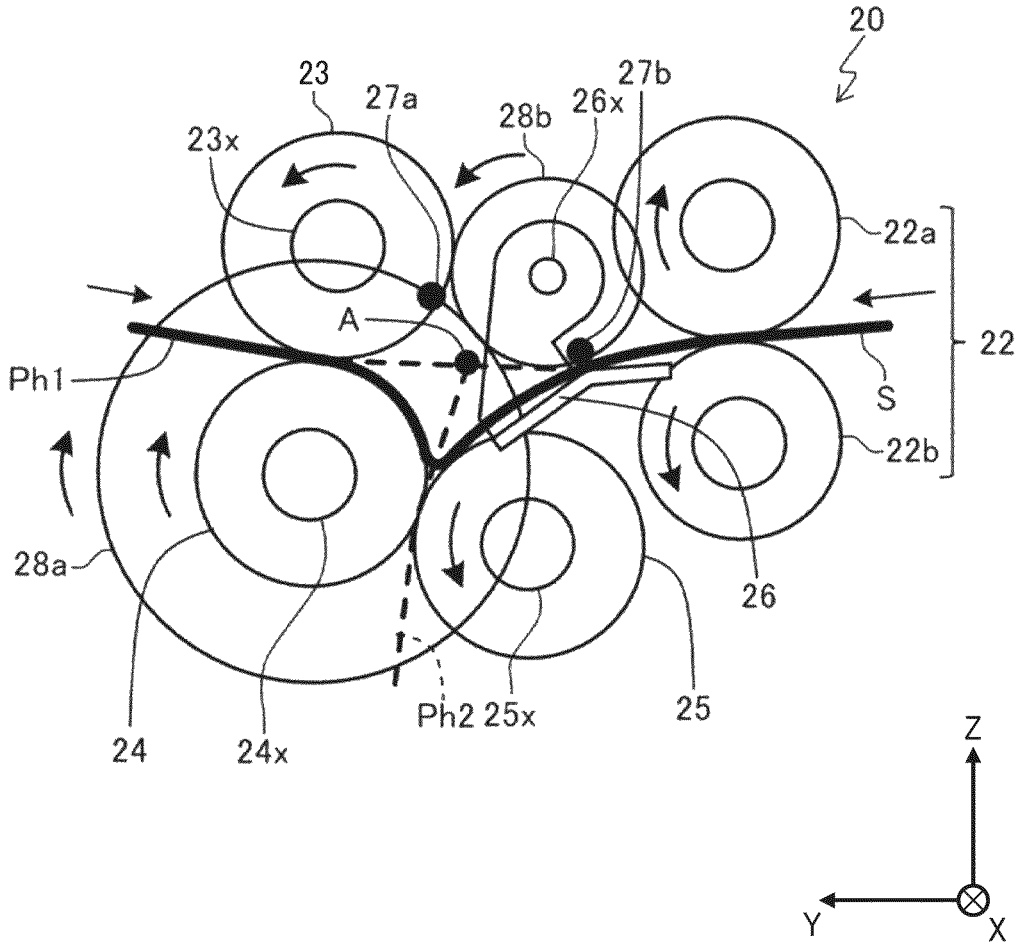
Figure 9A:
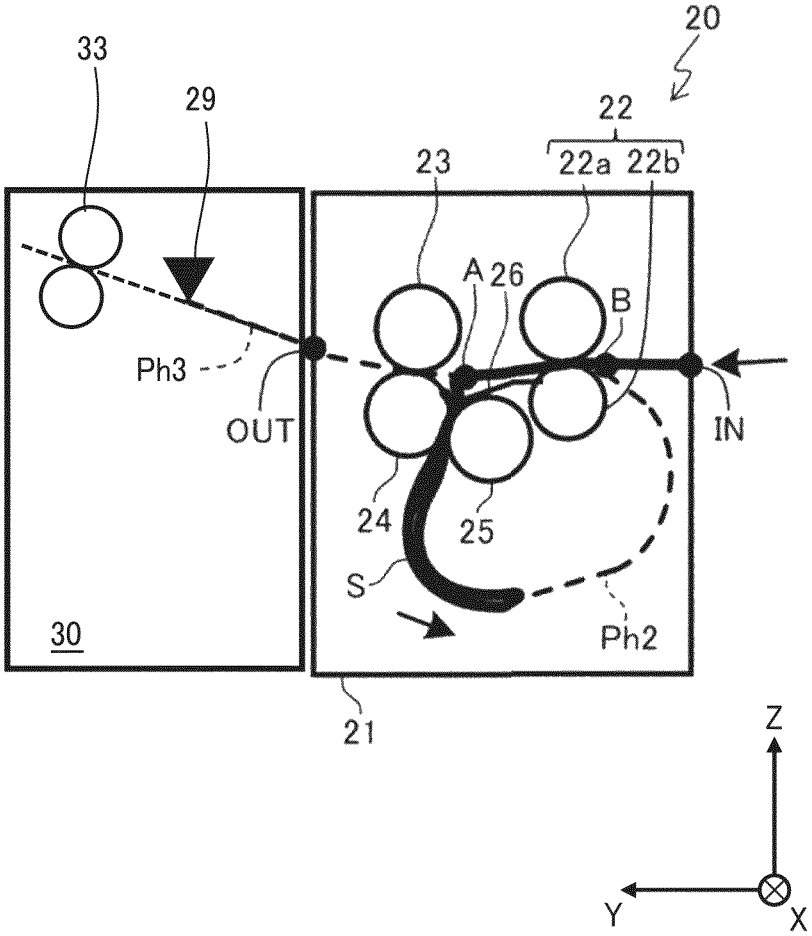
FIGS. 9A and 9B are diagrams illustrating a sheet folder before a sheet is folded at a second fold position, according to an embodiment of the present disclosure.
Figure 9B:
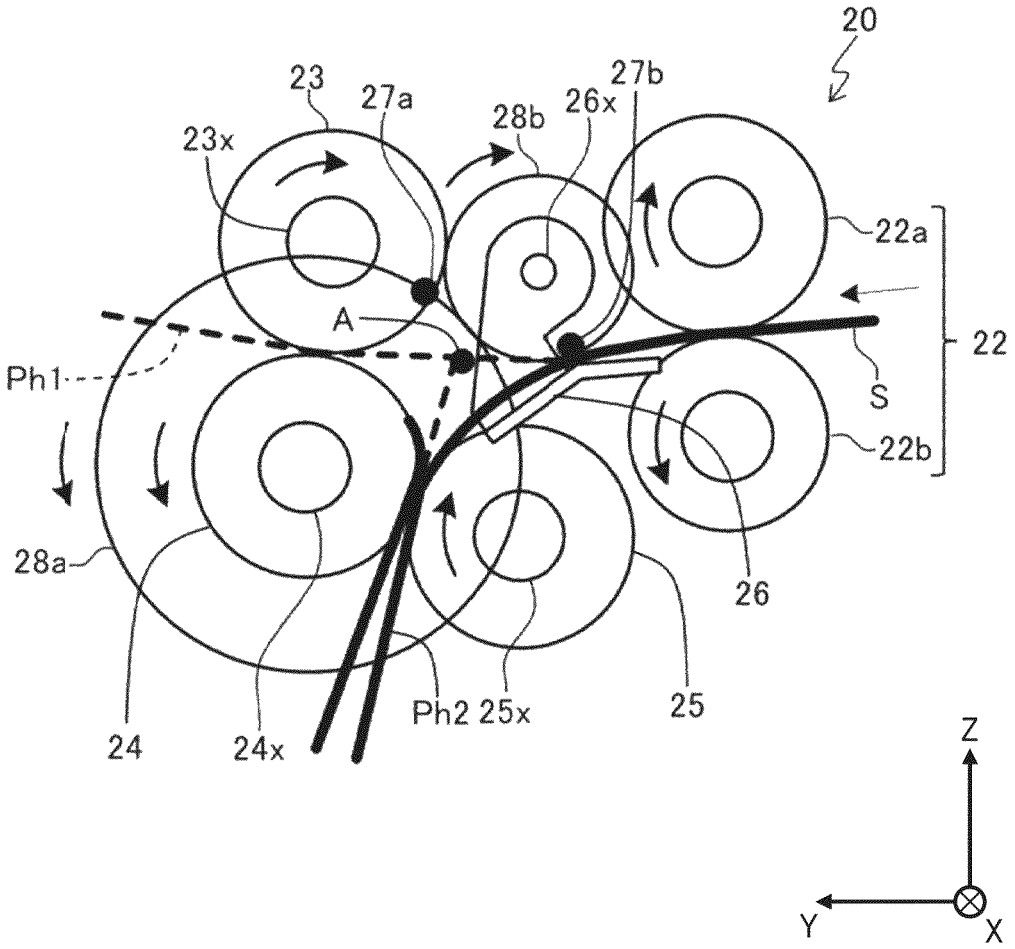
Figure 10A:
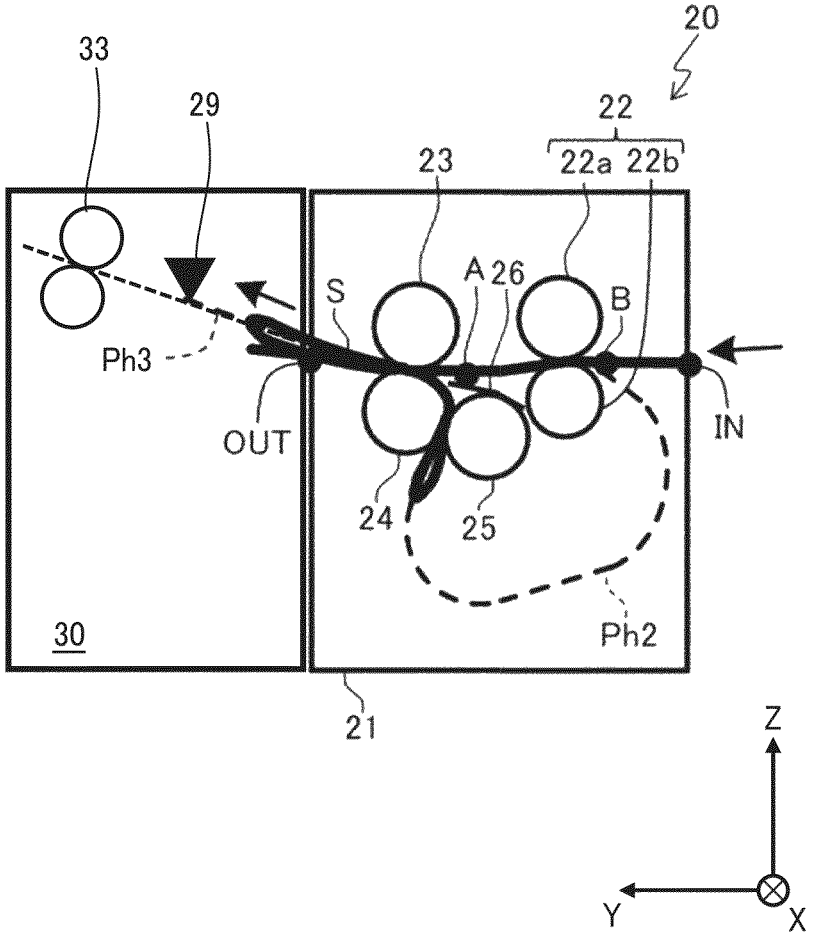
FIGS. 10A and 10B are diagrams illustrating a sheet folder after a sheet is folded at a second fold position, according to an embodiment of the present disclosure.
Figure 10B:
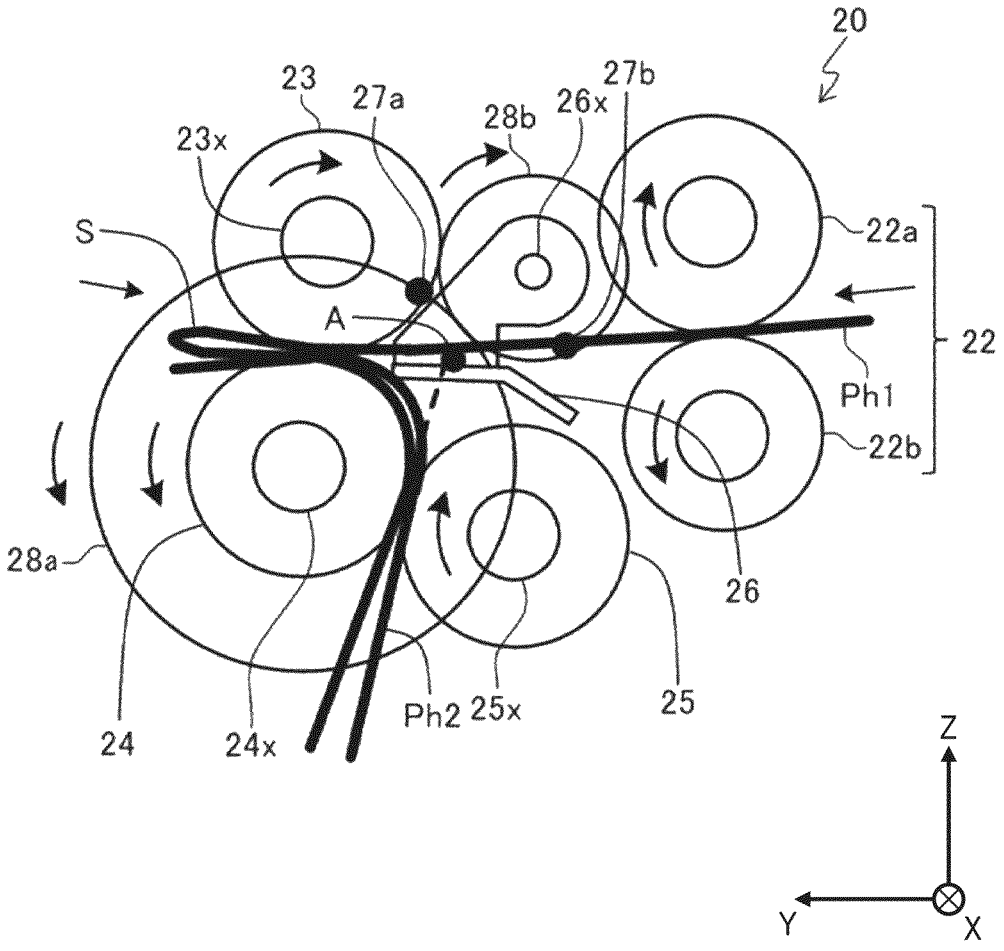

With reference to FIGS. 6 to 10B, a three-folding process in which the sheet S is folded by the Z-fold or the letter fold-out is described below. FIG. 6 is a flowchart of the three-folding process according to the present embodiment. FIGS. 7A and 7B are diagrams illustrating the sheet folder 20 before the sheet S is folded at the first fold position C1, according to the present embodiment. FIGS. 8A and 8B are diagrams illustrating the sheet folder 20 folding the sheet S at the first fold position C1, according to the present embodiment. FIGS. 9A and 9B are diagrams illustrating the sheet folder 20 before the sheet S is folded at the second fold position C2, according to the present embodiment. FIGS. 10A and 10B are diagrams illustrating the sheet folder 20 after the sheet S is folded at the second fold position C2, according to the present embodiment.

FIGS. 7A to 10B illustrate the sheet S conveyed in a forward direction or a reverse direction. The length of the sheet S illustrated in each of FIGS. 7 to 10 is expressed to illustrate the sheet folder 20 for the sake of explanatory convenience, and is different from the real length of the sheet S subject to the folding process.

The controller 100 illustrated in FIG. 4 starts the three-folding process illustrated in FIG. 6 in response to supplying the sheet S from the image forming section 12 to the input interface IN. How to fold the sheet S may be instructed by input to the operation panel 110 or a command transmitted from an external apparatus through a communication network. In other words, the first fold position C1 and the second fold position C2 on the sheet S in the conveyance direction may be instructed by input to the operation panel 110 or a command transmitted from an external apparatus through a communication network. The controller 100 controls the sheet folder 20 to shift the first fold position C1 and the second fold position C2 in the conveyance direction. As a result, the sheet folder 20 can perform both the Z-fold illustrated in FIG. 5A and the letter fold-out illustrated in FIG. 5B.

Figure 7A:
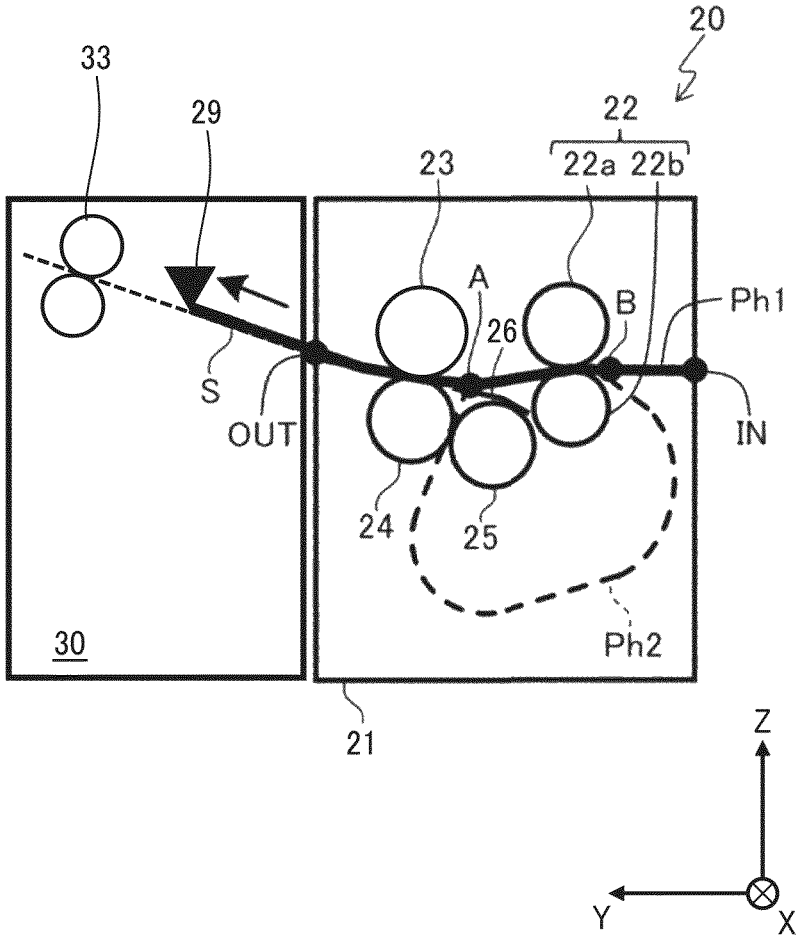
FIGS. 7A and 7B are diagrams illustrating a sheet folder before a sheet is folded at a first fold position, according to an embodiment of the present disclosure.
Figure 7B:
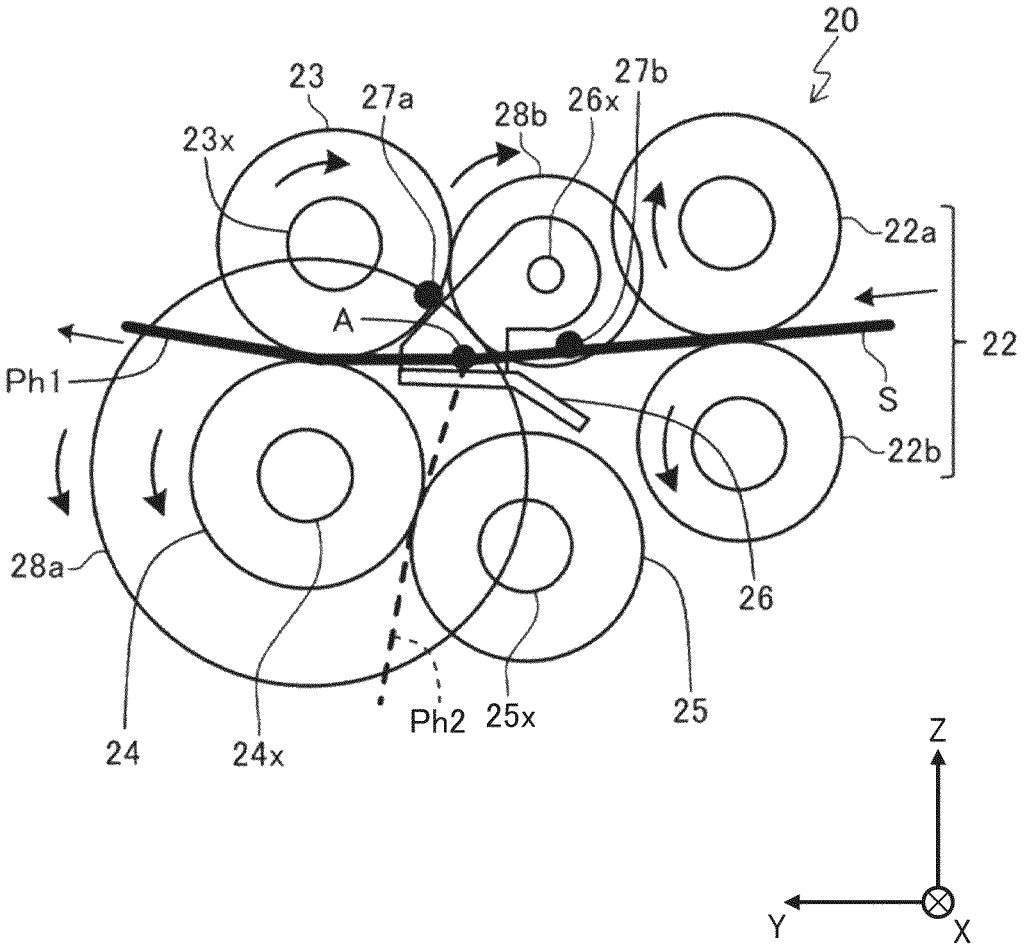

When the controller 100 starts the three-folding process, the controller 100 firstly rotates the conveyance roller pair 22, the first folding roller 23, and the second folding roller 24 in the forward direction as a first direction to receive the sheet S in the sheet folder 20 in step S601. Rotating the conveyance roller pair 22, the first folding roller 23, and the second folding roller 24 in the forward direction changes the posture of the guide plate 26 to the first guide posture as illustrated in FIGS. 7A and 7B. The conveyance roller pair 22, the first folding roller 23, and the second folding roller 24 convey the sheet S supplied through the input interface IN in the conveyance direction along the main conveyance path Ph1 toward the conveyance path Ph3 of the sheet binder 30. The controller 100 continues the processing of step S601 until the first fold position C1 on the sheet S reaches the branch position A (NO in step S602).

In the present embodiment, the controller 100 determines whether the first fold position C1 on the sheet S reaches the branch position A in the sheet folder 20 as follows.

The image forming apparatus 10 forms the image on each of the sheets having various sizes. The size of the sheet S is input to the operation panel 110 or is instructed from an external apparatus such as a personal computer. As a result, the controller 100 can identify the size of the sheet S conveyed to the sheet folder 20. The controller 100 calculates a length from the leading edge of the sheet S to the first fold position C1 based on the size of the sheet S. The controller 100 can specify the position of the leading edge of the sheet S based on a result of detection by the sheet sensor 29. Accordingly, the controller 100 can calculate a conveyance amount, which is referred to as a first conveyance amount, of the sheet S to convey the sheet S so that the first fold position C1 on the sheet S reaches the branch position A in the sheet folder after the sheet sensor 29 detects the leading edge of the sheet S. The controller 100 can obtain the conveyance amount of the sheet S based on the pulse signals of the rotary encoders 22*z*, 23*z*, 24*z*, and 25*z*. As a result, the controller 100 can determine whether the first fold position C1 on the sheet S reaches the branch position A in the sheet folder 20 based on the size of the sheet S, the pulse signals of the rotary encoders 22*z*, 23*z*, 24*z*, and 25*z*, and the detection of the leading edge of the sheet by the sheet sensor 29.

In response to the controller 100 determining that the leading edge of the sheet S in the conveyance direction is conveyed by the first conveyance amount based on the detection of the leading edge of the sheet by the sheet sensor 29 and the pulse signals of the rotary encoders 22*z*, 23*z*, 24*z*, and 25*z*, in other words, in response to the first fold position C1 reaching the branch position A (YES in step S602), the controller 100 rotates the conveyance roller pair 22 in the forward direction and rotates the first folding roller 23, the second folding roller 24, and the third folding roller 25 in the reverse direction as a second direction in step S603. Rotating the first folding roller 23, the second folding roller 24 and the third folding roller 25 in the reverse direction changes the posture of the guide plate 26 to the second posture as illustrated in FIG. 8B. The sheet S enters the return conveyance path C1 with the first fold position C1 as the leading edge and is nipped by the second fold roller 24 and the third folding roller 25. As a result, the sheet S is folded at the first fold position C1.

Subsequently, the controller 100 continues the processing of step S603 until the leading edge of the sheet S is conveyed by a designated conveyance amount, which is referred to as a second conveyance amount to distinguish from the first conveyance amount, as illustrated in FIGS. 9A and 9B (NO in step S604). In order to distinguish a nip between the second folding roller 24 and the third folding roller 25 from the nip between the first folding roller 23 and the second folding roller 24, the nip between the first folding roller 23 and the second folding roller 24 is referred to as a first nip below, and the nip between the second folding roller 24 and the third folding roller 25 is referred to as a second nip below.

At this time, the controller 100 determines whether the sheet S is conveyed by the second conveyance amount based on rotation amounts of the first to third folding rollers after the controller 100 starts conveying the sheet S in the reverse direction and does not receive a signal notifying that the sheet sensor 29 detects the sheet S from the sheet sensor 29 (that is, a non-detection of an edge of the sheet by the sheet sensor).

The second conveyance amount means the amount by which the sheet S is conveyed until the leading edge of the sheet S reaches a predetermined position after the controller starts rotating the first folding roller 23, the second folding roller 24, and the third folding roller 25 in the reverse direction. The controller 100 obtains the predetermined position based on the input to the operation panel 110 or the command transmitted from the external device via the communication network. The controller 100 can determine the timing at which the sheet S is conveyed by the second conveyance amount based on the rotation amounts of the first to third folding rollers after the controller 100 does not receive the signal notifying that the sheet sensor 29 detects the sheet S from the sheet sensor 29.

At the timing at which the sheet S is conveyed in the reverse direction by the second conveyance amount determined based on the signal from the sheet sensor 29 by the controller 100, in other words, at the timing at which the leading edge of the sheet S passes through the first nip between the first folding roller 23 and the second folding roller 24 (YES in step S604), the controller 100 rotates the conveyance roller pair 22, the first folding roller 23, and the second folding roller 24 in the forward direction as the first direction in step S605. As a result, as illustrated in FIGS. 10A and 10B, the guide plate 26 changes its posture to the first posture. The sheet S enters the first nip between the first folding roller 23 and the second folding roller 24 with the leading edge of the sheet S and the second fold position C2 at the head. As a result, the sheet S is folded at the second fold position C2, and the three-folding process to form the Z-fold and the letter fold-out is completed.

After the controller switches the direction in which the sheet S is conveyed to the forward direction in step S605, the sheet sensor 29 detects the sheet. After the sheet sensor 29 detects the sheet S, the controller 100 determines whether the trailing edge of the sheet S passes through the first nip between the first folding roller 23 and the second folding roller 24 in the conveyance direction based on the rotation amounts of the first folding roller 23 and the second folding roller 24 in step S606.

Figure 11:
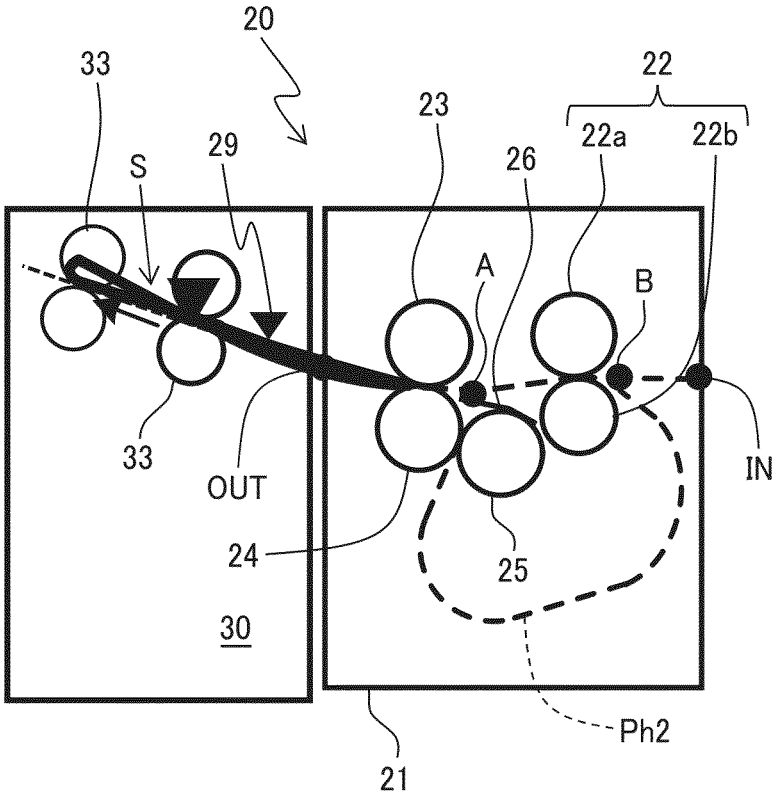
FIG. 11 is a diagram illustrating a sheet folder ejecting a sheet folded by a three-folding process to convey the sheet in a downstream device, according to an embodiment of the present disclosure.

The controller 100 continues conveying the sheet S in the forward direction in step S605 until the trailing edge of the sheet S passes through the first nip between the first folding roller 23 and the second folding roller 24 in the conveyance direction (No in step S606), in other words, until the sheet S folded in three is ejected from the first nip as illustrated in FIG. 11.

In response to the controller 100 determining that the trailing edge of the sheet S has passed through the first nip between the first folding roller 23 and the second folding roller 24 in the conveyance direction (YES in step S606), the controller 100 stops the rotations of the conveyance roller pair 22, the first folding roller 23, and the second folding roller 24 and ends the three-folding process.

[Two-Folding Process]

Figure 12:
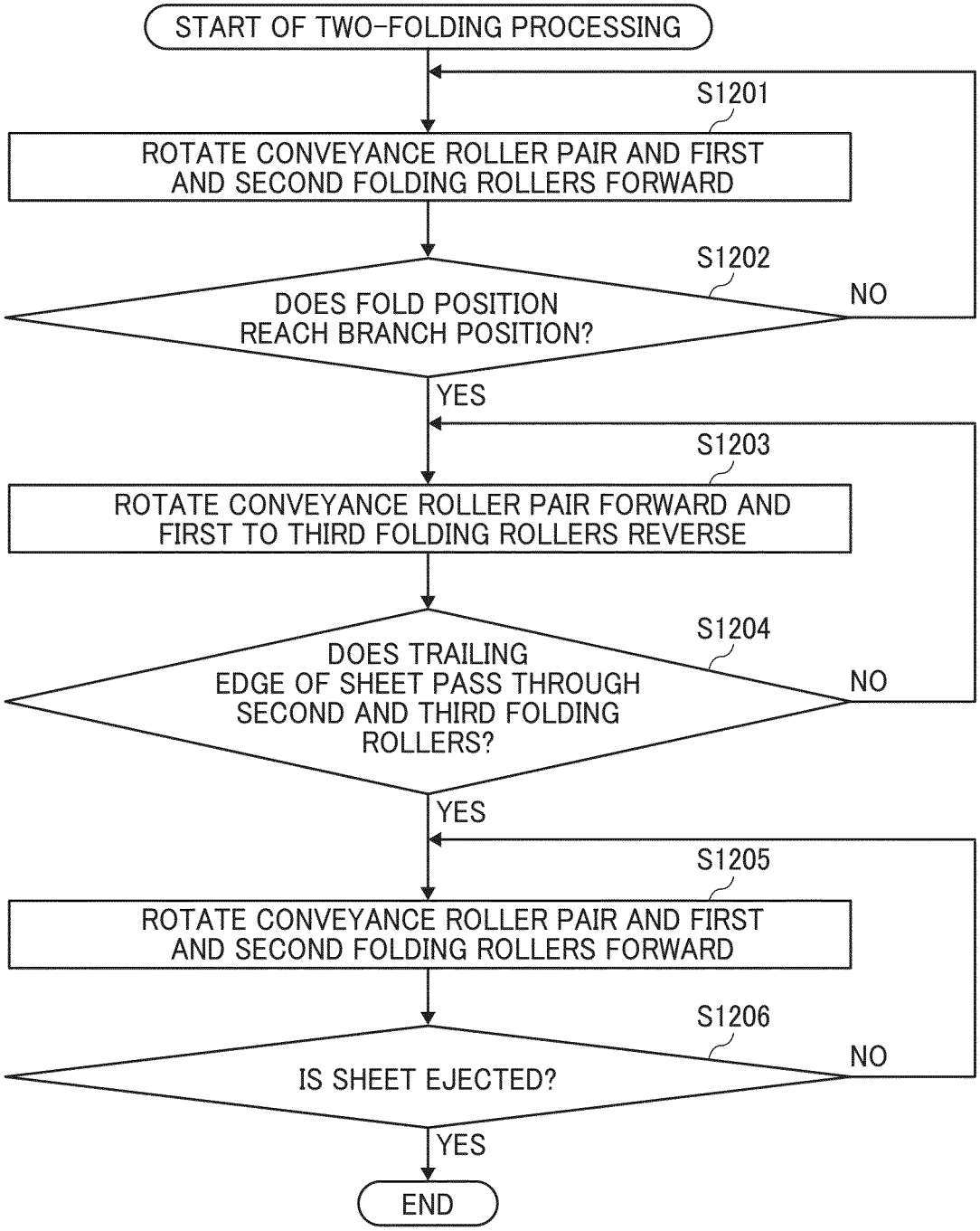
FIG. 12 is a flowchart of a two-folding process according to an embodiment of the present disclosure.
Figure 13A:
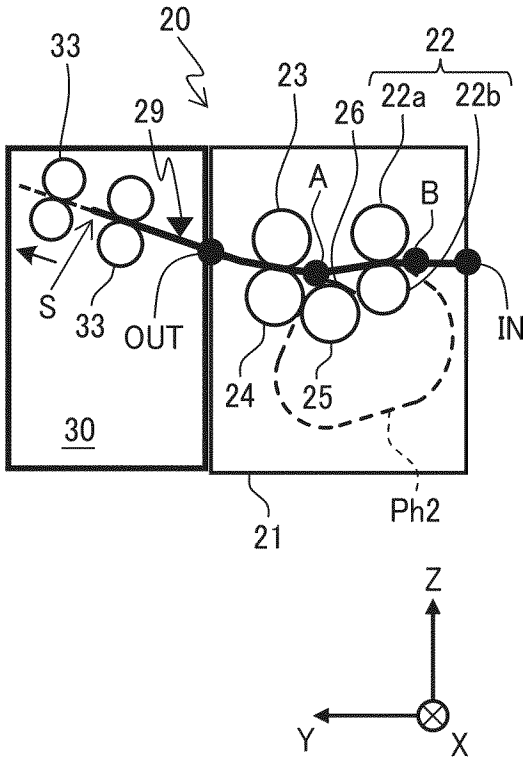
FIGS. 13A to 13F are diagrams illustrating a sheet folder during a two-folding process according to an embodiment of the present disclosure.
Figure 13B:
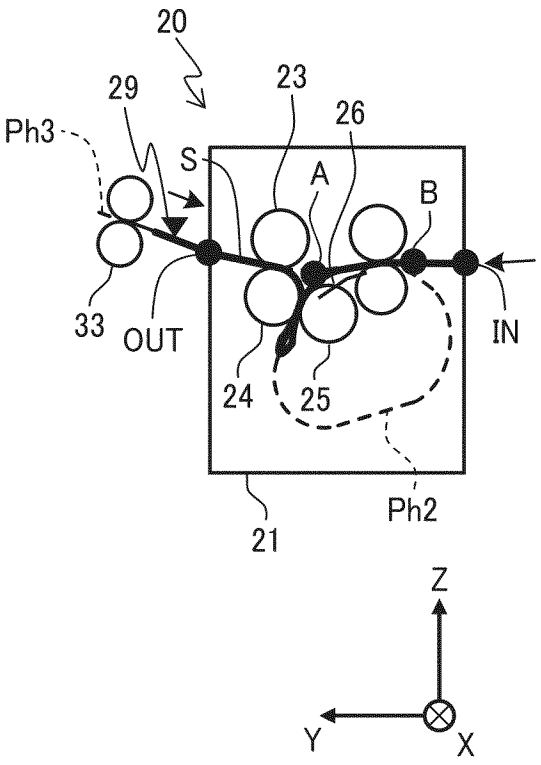
Figure 13C:
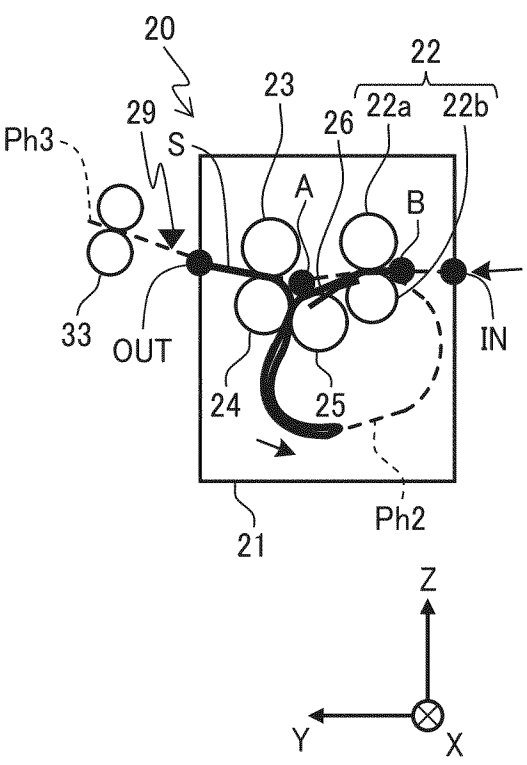
Figure 13D:
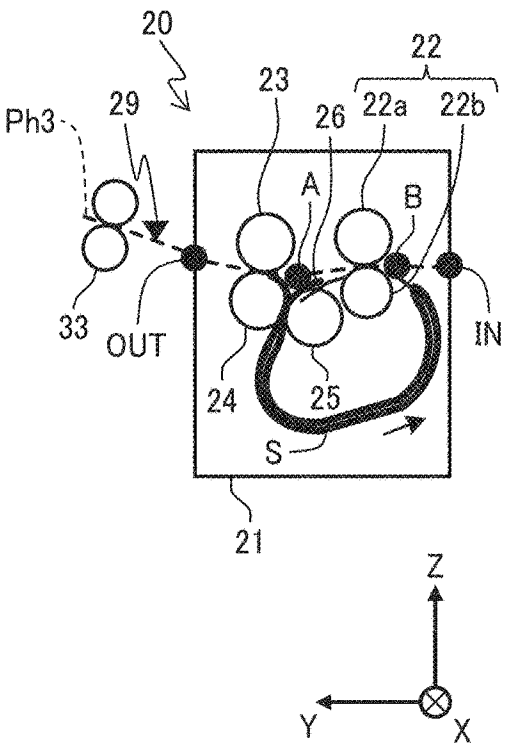
Figure 13E:
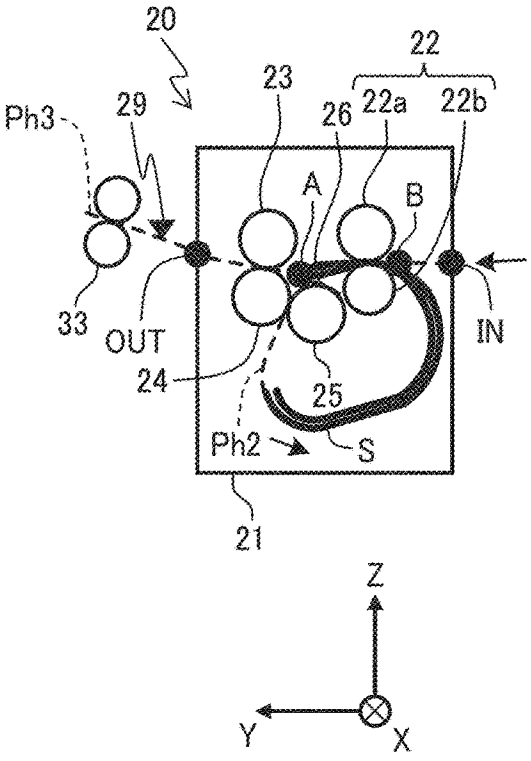
Figure 13F:
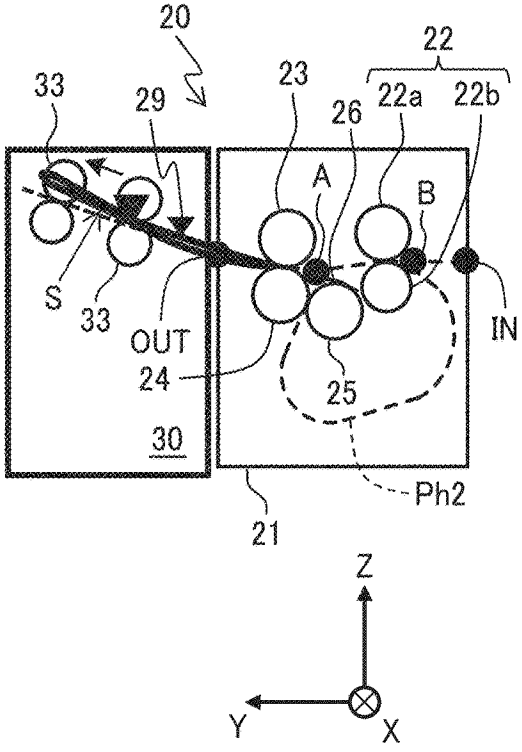

With reference to FIGS. 12 to 13F, a two-folding process in which the sheet S is folded by the half-fold is described below. FIG. 12 is a flowchart of the two-folding process according to the present embodiment. FIGS. 13A to 13F are diagrams illustrating the sheet folder 20 during the two-folding process, according to the present embodiment. The detailed description of the two-folding process common to the three-folding process is omitted and the description of the two-folding process different from the three-folding process is given.

When the controller 100 starts the two-folding process, the controller 100 firstly rotates the conveyance roller pair 22, the first folding roller 23, and the second folding roller 24 in the forward direction as the first direction in step S1201. As a result, as illustrated in FIG. 13A, the guide plate 26 changes its posture to the first posture. In step S1201, the sheet S passes through the input interface IN, is supplied to the sheet folder 20, and is conveyed along the main conveyance path Ph1 in the conveyance direction. The controller 100 continues the process of step S1201 until the sheet sensor 29 detects the leading edge of the sheet S, in other words, until the conveyance amount of the sheet S conveyed in the conveyance direction along the main conveying path Ph1 reaches the first conveyance amount (NO in step S1202). The controller 100 continues the processing of step S1201 until a fold position C on the sheet S reaches the branch position A.

In response to the controller 100 determining that the leading edge of the sheet S in the conveyance direction is conveyed by the first conveyance amount based on the detection of the leading edge of the sheet by the sheet sensor 29, in other words, in response to the fold position C reaching the branch position A (YES in step S1202), the controller 100 rotates the conveyance roller pair 22 in the forward direction and rotates the first folding roller 23, the second folding roller 24, and the third folding roller 25 in the reverse direction as the second direction in step S1203. As a result, as illustrated in FIGS. 13B to 13D, the guide plate 26 changes its posture to the second posture, and the fold position C on the sheet S becomes the leading edge entering the return conveyance path Ph2. The sheet S is nipped by the second folding roller 24 and the third folding roller 25 and is folded in two at the fold position C. Subsequently, the controller 100 continues the processing of step S1203 until the trailing edge of the sheet S passes through the second nip between the second folding roller 24 and the third folding roller 25 in the conveyance direction (NO in step S1204), in other words, until the sheet is conveyed by the second conveyance amount in the return conveyance path Ph2.

At a timing at which the trailing edge of the sheet S passes through the second nip between the second folding roller 24 and the third folding roller 25 (YES in step S1204), in other words, the timing at which the sheet S is conveyed by a third conveyance amount as illustrated in FIG. 13D, the controller 100 rotates the first folding roller 23 and the second folding roller 24 in the forward direction as the first direction in step S1205. The controller 100 continues rotating the conveyance roller pair 22 in the forward direction. As a result, as illustrated in FIGS. 13E and 13F, the guide plate 26 changes its posture to the first posture, and the sheet S passes through the first nip between the first folding roller 23 and the second folding roller 24 with the fold position C as the leading edge.

After the controller switches the direction in which the sheet S is conveyed to the forward direction in step S1205, the sheet sensor 29 detects the sheet. After the sheet sensor 29 detects the sheet S, the controller 100 determines whether the trailing edge of the sheet S passes through the first nip between the first folding roller 23 and the second folding roller 24 in the conveyance direction based on the rotation amounts of the first folding roller 23 and the second folding roller 24 in step S1206. Subsequently, the controller 100 continues the processing of step S1205 until the trailing edge of the sheet S passes through the first nip between the first folding roller 23 and the second folding roller 24 in the conveyance direction (NO in step S1206), in other words, until the sheet subjected to the two-folding process is completely ejected.

At a timing at which the trailing edge of the sheet S passes through the first nip between the first folding roller 23 and the second folding roller 24 in the conveyance direction (YES in step S1206), the controller 100 stops rotating the conveyance roller pair 22, the first folding roller 23, and the second folding roller 24 to complete the two-folding process.

The controller 100 does not need to execute the three-folding process or the two-folding process on all the sheets S on which the images are formed by the image forming section 12. When the sheet folder does not fold the sheet S, the sheet S passes through the sheet folder 20 and is ejected from the sheet folder 20. The controller 100 rotates the conveyance roller pair 22, the first folding roller 23, and the second folding roller 24 in the forward direction until the trailing edge of the sheet S passes through the first nip between the first folding roller 23 and the second folding roller 24 in the conveyance direction in response to the sheet S being supplied from the image forming section 12 to the input interface IN.

The above-described control is performed by the controller 100 in the sheet folder 20 according to the present embodiment, using a result of detection by the sheet sensor 29 in another unit outside the housing of the sheet folder 20. In other words, the control in which the sheet bearing the image formed by the image forming section 12 is folded by the sheet folder 20 and delivered to the sheet binder 30 is performed, using a result of detection by the sheet sensor 29 in another unit outside the housing of the sheet folder 20. As a result, the number of components in the sheet folder 20 can be reduced.

The controller 100 controlling the sheet folder 20 can also perform control in which the sheet S bearing the image formed by the image forming section 12 is not folded by the sheet folder 20 and is delivered to the sheet binder 30. The controller 100 may be configured to switch contents of the control based on an instruction instructed by input to the operation panel 110 or a command transmitted from an external apparatus through a communication network.

[Modification]

Figure 14:
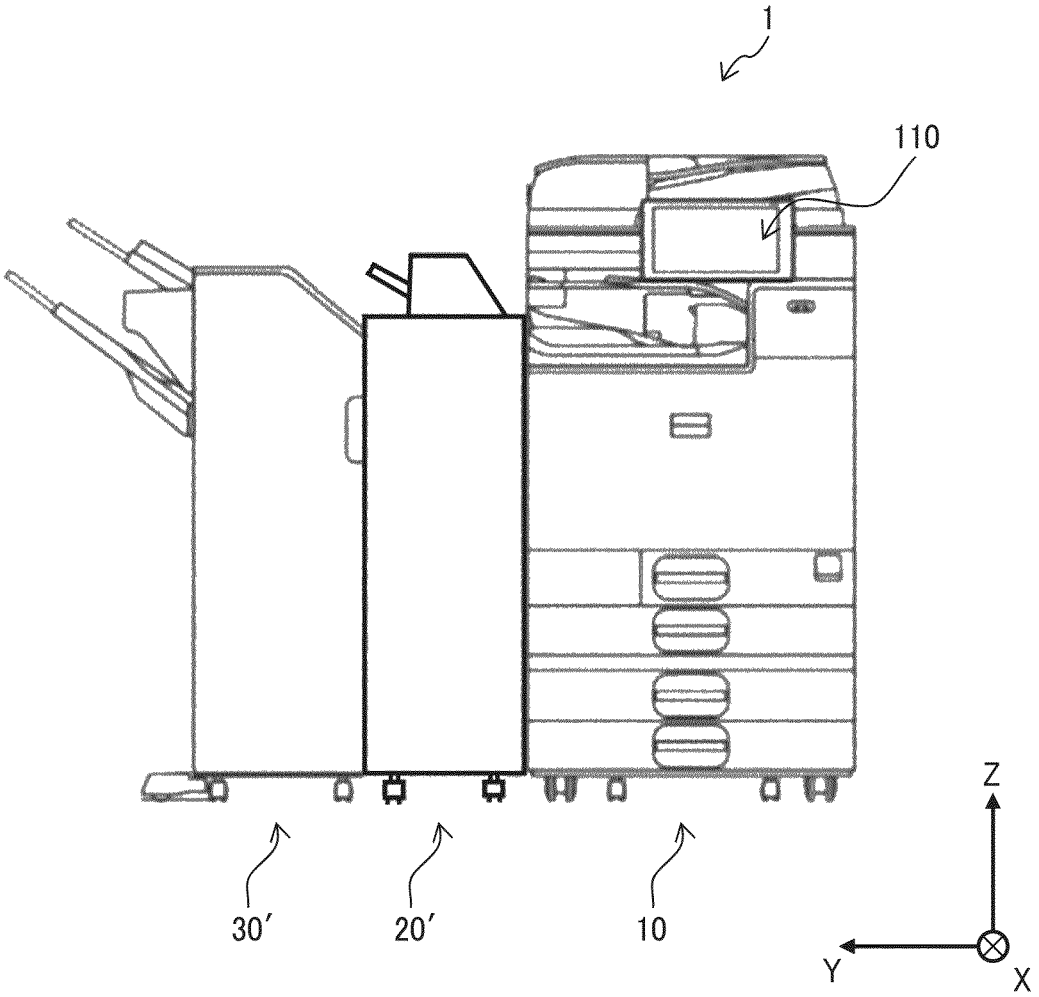
FIG. 14 is an external view of an image forming system according to an embodiment of the present disclosure The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

FIG. 14 is an external view of an image forming system 1 according to a modification of the above embodiments of the present disclosure. As illustrated in FIG. 14, the image forming system 1 includes the image forming apparatus 10, a sheet folder 20', and a sheet binder 30'. The image forming apparatus 10, the sheet folder 20', and the sheet binder 30' are apparatuses that can operate independently of each other and are configured to be connectable to each other. The sheet folder 20' has the same configuration as the sheet folder 20 described above, and the sheet binder 30' has the same configuration as the sheet binder 30 described above.

The present disclosure is not limited to specific embodiments described above, and numerous additional modifications and variations are possible in light of the teachings within the technical scope of the present disclosure. It is therefore to be understood that the above-described embodiments of the present disclosure may be practiced otherwise by those skilled in the art than as specifically described herein. Such modifications and alternatives are within the technical scope of the appended claims.

Aspects of the present disclosure are, for example, as follows.

First Aspect

In a first aspect, a sheet processing device includes an upstream device, a downstream device, and a controller as circuitry. The upstream device includes multiple rollers to convey a sheet in a conveyance direction and perform a sheet processing. The downstream device is downstream from the upstream device in the conveyance direction. The downstream device includes a sheet sensor to detect the sheet. The controller controls a timing to rotate the multiple rollers of the upstream device to perform the sheet processing in response to a detection of the sheet by the sheet sensor.

Second Aspect

In a second aspect, the sheet sensor in the sheet processing device according to the first aspect is adjacent to an entrance of the downstream device from the upstream device in the conveyance direction.

Third Aspect

In a third aspect, the downstream device in the sheet processing device according to the first aspect further includes multiple rollers, and the sheet sensor is upstream from a most upstream roller disposed most upstream among the multiple rollers in the conveyance direction.

Fourth Aspect

In a fourth aspect, the controller as the circuitry in the sheet processing apparatus according to any one of the first to third aspects rotates the multiple rollers in a first direction to convey the sheet in the conveyance direction and rotates some of the multiple rollers in a second direction opposite to the first direction to perform the sheet processing in response to a detection of an edge of the sheet by the sheet sensor.

Fifth Aspect

In a fifth aspect, the controller as the circuitry in the sheet processing apparatus according to any one of the first to fourth aspects rotates the multiple rollers in a first direction to convey the sheet in the conveyance direction, rotates some of the multiple rollers in a second direction opposite to the first direction to perform the sheet processing in response to a detection of an edge of the sheet by the sheet sensor, and rotates the multiple rollers in the first direction again to convey the sheet, processed by the sheet processing, in the conveyance direction in response to a non-detection of the sheet by the sheet sensor.

Sixth Aspect

In a sixth aspect, an image forming apparatus includes an image forming section to form an image on a sheet and a housing. The housing houses the image forming section and the sheet processing device according to any one of the first to fifth aspects to fold the sheet bearing the image formed by the image forming section.

Seventh Aspect

In a seventh aspect, an image forming apparatus includes an image forming section, an upstream device, a downstream device, and a controller as circuitry. The image forming section forms an image on a sheet. The upstream device includes multiple rollers to convey the sheet, on which the image is formed by the image forming section, in a conveyance direction and perform a sheet processing. The downstream device is downstream from the upstream device in the conveyance direction. The downstream device includes a sheet sensor to detect the sheet. The controller controls a timing to rotate the multiple rollers to perform the sheet processing in response to a detection of the sheet by the sheet sensor.

Eighth Aspect

In an eighth aspect, the image forming apparatus according to the seventh aspect includes a housing. The housing houses the image forming section and an in-body space to house the upstream device and the downstream device.

Ninth Aspect

In a ninth aspect, an image forming system includes an image forming apparatus to form an image on a sheet and the sheet processing device according to any one of the first to fifth aspects to process the sheet bearing the image formed by the image forming apparatus.

The above-described embodiments are illustrative and do not limit the present disclosure. Thus, numerous additional modifications and variations are possible in light of the above teachings. For example, elements and/or features of the embodiment and variation may be combined with each other and/or substituted for each other within the scope of the present disclosure.

The advantages achieved by the embodiments described above are examples and therefore are not limited to those described above.

The functionality of the elements disclosed herein may be implemented using circuitry or processing circuitry which includes general purpose processors, special purpose processors, integrated circuits, application specific integrated circuits (ASICs), digital signal processors (DSPs), field programmable gate arrays (FPGAs), conventional circuitry and/or combinations thereof which are configured or programmed to perform the disclosed functionality. Processors are considered processing circuitry or circuitry as they include transistors and other circuitry therein. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

The invention claimed is:

1. A sheet processing device comprising:

an upstream device including multiple rollers to:

convey a sheet in a conveyance direction; and perform a sheet processing;

a downstream device downstream from the upstream device in the conveyance direction, the downstream device including a sheet sensor to detect the sheet; and circuitry configured to control a timing to rotate the multiple rollers of the upstream device to perform the sheet processing in response to a detection of the sheet by the sheet sensor, wherein the downstream device includes a first housing, and wherein the upstream device includes a second housing.

2. The sheet processing device according to claim 1, wherein the sheet sensor is adjacent to an entrance of the downstream device from the upstream device in the conveyance direction.

3. The sheet processing device according to claim 1, wherein the downstream device further includes multiple rollers, and the sheet sensor is upstream from a most upstream roller disposed most upstream among the multiple rollers in the conveyance direction.

4. The sheet processing device according to claim 1, wherein the circuitry is further configured to:

rotate the multiple rollers in a first direction to convey the sheet in the conveyance direction; and rotate some of the multiple rollers in a second direction opposite to the first direction to perform the sheet processing in response to a detection of an edge of the sheet by the sheet sensor.

5. The sheet processing device according to claim 1, wherein the circuitry is further configured to:

rotate the multiple rollers in a first direction to convey the sheet in the conveyance direction;

rotate some of the multiple rollers in a second direction opposite to the first direction to perform the sheet processing in response to a detection of an edge of the sheet by the sheet sensor; and rotate the multiple rollers in the first direction again to convey the sheet, processed by the sheet processing, in the conveyance direction in response to a non-detection of the sheet by the sheet sensor.

6. An image forming apparatus comprising:

an image forming section to form an image on a sheet; and a third housing:

the image forming section; and the sheet processing device according to claim 1 to fold the sheet bearing the image formed by the image forming section.

7. An image forming system comprising:

an image forming apparatus to form an image on a sheet; and the sheet processing device according to claim 1 to process the sheet bearing the image formed by the image forming apparatus.

8. An image forming apparatus comprising:

an image forming section to form an image on a sheet;

an upstream device including multiple rollers to:

convey the sheet, on which the image is formed by the image forming section, in a conveyance direction; and perform a sheet processing;

a downstream device downstream from the upstream device in the conveyance direction, the downstream device including a sheet sensor to detect the sheet; and circuitry configured to control a timing to rotate the multiple rollers to perform the sheet processing in response to a detection of the sheet by the sheet sensor, wherein the downstream device includes a first housing, and wherein the upstream device includes a second housing.

9. The image forming apparatus according to claim 8, further comprising a third housing:

the image forming section; and an in-body space to house:

the upstream device; and the downstream device.

10. A sheet processing device comprising:

an upstream device including multiple rollers to:

convey a sheet in a conveyance direction; and perform a sheet processing;

a downstream device downstream from the upstream device in the conveyance direction, the downstream device including a sheet sensor to detect the sheet; and circuitry configured to control a timing to rotate the multiple rollers of the upstream device to perform the sheet processing in response to a detection of the sheet by the sheet sensor, wherein the upstream device is removably attached to the sheet processing device.

* * * * *